US009401559B2

(12) United States Patent
Ota et al.

(10) Patent No.: US 9,401,559 B2
(45) Date of Patent: Jul. 26, 2016

(54) ELECTRICAL CONNECTOR HAVING TERMINALS AT DIFFERENT HEIGHTS

(71) Applicant: J.S.T. Mfg. Co., Ltd., Osaka-shi (JP)

(72) Inventors: Satoshi Ota, Miyoshi (JP); Hiroaki Segawa, Miyoshi (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 14/694,169

(22) Filed: Apr. 23, 2015

(65) Prior Publication Data

US 2015/0311653 A1 Oct. 29, 2015

(30) Foreign Application Priority Data

Apr. 24, 2014 (JP) ..... 2014-090749

(51) Int. Cl.
*H01R 24/00* (2011.01)
*H01R 13/422* (2006.01)
*H01R 12/71* (2011.01)

(52) U.S. Cl.
CPC ..... *H01R 13/422* (2013.01); *H01R 12/716* (2013.01)

(58) Field of Classification Search
CPC .. H01R 24/62; H01R 13/422; H01R 2107/00; H01R 12/716
USPC ..... 439/676, 83, 79
See application file for complete search history.

(56) References Cited

U.S. PATENT DOCUMENTS 4,296,991 A * 10/1981 Hughes ..... H01R 24/62 379/442

FOREIGN PATENT DOCUMENTS

JP 2011-113801 A1 6/2011

OTHER PUBLICATIONS

Machine translation of JP 2011-113801. Jan. 25, 2016.*

* cited by examiner

*Primary Examiner* — Javid Nasri
(74) *Attorney, Agent, or Firm* — Kratz, Quintos & Hanson, LLP

(57) ABSTRACT

An electrical connector having terminals at different heights includes: a housing having a vertical wall provided with a first hole and a second hole on the counter mating side thereof; a first terminal press-fitted into the first hole; and a second terminal press-fitted into the second hole. A recessed portion is provided between the first hole and the second hole in the vertical wall. A first press-fitting portion is press-fitted into the vertical wall by coming into pressure contact with, among the wall surfaces constituting the first hole in the vertical wall, the wall surfaces on the two width direction sides, and a second press-fitting portion is press-fitted into the vertical wall by coming into pressure contact with, among the wall surfaces constituting the second hole in the vertical wall, the wall surfaces on the two width direction sides and the wall surfaces on the two height direction sides.

20 Claims, 17 Drawing Sheets

ELECTRICAL CONNECTOR HAVING TERMINALS AT DIFFERENT HEIGHTS

CLAIM TO PRIORITY

This application claims priority to Japanese Application No. 2014-090749, filed Apr. 24, 2014, which is incorporated herein in its entirety by reference.

BACKGROUND OF THE INVENTION

1. Field of the Invention

The present invention belongs to the technical field of electrical connectors, and relates to an electrical connector having terminals at different heights.

2. Background of the Related Art

JP-2011-113801-A discloses a connector in which a flat plate-shaped terminal is inserted into and retained in a terminal insertion hole. This connector has a configuration in which a locking protrusion portion is provided on either the upper or lower face of the terminal, and the locking protrusion portion is brought into contact with the inner wall surface of the terminal insertion hole. According to this configuration, it is possible to increase the terminal retaining strength and prevent a terminal connection failure during user handling. Also, by lowering the clearance between the inner wall surface and the upper and lower surfaces of the terminal (increasing the area of contact), the terminal can be positioned on the mounting surface of a circuit substrate with high accuracy, and co-planarity can be improved.

SUMMARY OF THE INVENTION

When this type of electrical connector is mounted on a mounting target member such as a printed wiring board, the leg portion of the terminal of the electrical connector is soldered to the mounting target member by reflow soldering or the like. In this case, the electrical connector undergoes deformation due to heat from the reflow soldering apparatus. One type of this electrical connector is an electrical connector having terminals at different heights. It includes a housing having a vertical wall that rises upward from the mounting side toward the counter mounting side, and a first terminal and a second terminal that are press-fitted to the vertical wall at respective locations that are separated from each other in the rising direction, and the leg portion of the first terminal and the leg portion of the second terminal are each soldered to the mounting target member on the mounting side thereof. With this electrical connector having terminals at different heights, there are cases where the first terminal and the second terminal have different tendencies with respect to deformation caused by heat from the reflow soldering apparatus, and this can lead to the problem of not being able to obtain co-planarity between the leg portions of the two terminals. Not being able to obtain co-planarity between the leg portions of the two terminals can also refer to unevenness between the mounting surfaces of the leg portions of the two terminals, not being able to obtain flatness for the mounting surfaces of the two terminals, or a common plane not being formed by the mounting surfaces of the two terminals. In particular, the inventor of the present invention discovered that this tendency becomes pronounced when a recessed portion receding from the leg portion side is provided in order to remove or thin-out a portion of the housing between the press fitting portion for the first terminal and the press fitting portion for the second terminal in the vertical wall. If co-planarity is not obtained between the leg portions of the two terminals, an excessive gap is formed between the leg portions of the terminals and the mounting surface of the mounting target member, and there is the risk of a soldering defect.

As a result of making attempts at various countermeasures, the inventor of the present invention realized an electrical connector having terminals at different heights that can solve the above-described problems.

An electrical connector having terminals at different heights according to the present invention is an electrical connector having terminals at different heights that includes:

a housing having a vertical wall that faces a mating direction and rises from a mounting side toward a counter mounting side along a height direction that is orthogonal to the mating direction, and being provided with a first hole that passes through the vertical wall in the mating direction and a second hole that passes through the vertical wall in the mating direction on the counter mounting side relative to the first hole;

a first terminal having a first press-fitting portion that is fitted into the first hole, a first contact portion that protrudes from the first press-fitting portion toward a mating side, and a first leg portion that protrudes from the first press-fitting portion toward a counter mating side and then extends toward the mounting side; and a second terminal having a second press-fitting portion that is fitted into the second hole, a second contact portion that protrudes from the second press-fitting portion toward the mating side, and a second leg portion that protrudes from the second press-fitting portion toward the counter mating side and then extends toward the mounting side, wherein a recessed portion that is recessed from the counter mating side toward the mating side is provided between the first hole and the second hole in the vertical wall, the first press-fitting portion is press-fitted into the vertical wall by coming into pressure contact with, among wall surfaces that constitute the first hole in the vertical wall, wall surfaces on two sides in a width direction that is orthogonal to the mating direction and the height direction, and the second press-fitting portion is press-fitted into the vertical wall by coming into pressure contact with, among wall surfaces that constitute the second hole in the vertical wall, wall surfaces on two sides in the width direction and wall surfaces on two sides in the height direction.

When the housing without the first terminal and the second terminal press-fitted therein receives heat from a heating means such as a reflow soldering apparatus, due to thermal deformation, a wall between the recessed portion and the first hole becomes inclined such that the tip of the wall on the counter mating side moves closer to the mounting side than the mating side portion, and a wall between the recessed portion and the second hole becomes inclined such that the tip of the wall on the counter mating side moves closer to the counter mounting side than the mating side portion, and the inclination of the wall between the recessed portion and the second hole tends to be larger than the inclination of the wall between the recessed portion and the first hole. For this reason, if the press-fitting of the first press-fitting portion into the vertical wall and the press-fitting of the second press-fitting portion into the vertical wall are performed under the same conditions, deviation occurs between height direction displacement of the first leg portion and the second leg portion, and this impairs the co-planarity of the first leg portion and the second leg portion. However, in the case of the above-described electrical connector having terminals at different heights, in the press-fitting of first press-fitting portion, pressure is not applied to the wall surfaces on the two sides in the height direction among the wall surfaces that constitute the first hole in the vertical wall, and therefore the comparatively small inclination of the wall between the recessed portion and the first hole is kept approximately the same. On the other hand, in the press-fitting of the second press-fitting portion, pressure is applied to the wall surfaces on the two sides in the height direction among the wall surfaces that constitute the second hole in the vertical wall, and therefore due to this pressure, the wall between the recessed portion and the second hole is pressed toward the mounting side, and the inclination thereof decreases. This suppresses the case where the second leg portion becomes more displaced toward the counter mounting side than the first leg portion, thus raising the possibility of obtaining favorable co-planarity between the first leg portion and the second leg portion. Also, in the press-fitting of the first press-fitting portion, pressure is not applied to the wall surfaces on the two sides in the height direction among the wall surfaces that constitute the first hole in the vertical wall, and therefore the wall between the recessed portion and the first hole is not pressed toward the mounting side by pressure in the press-fitting. This reduces the risk of an increase in the size of the gap in the height direction between the first leg portion and the second leg portion, and reduces the risk of impairing the co-planarity of the first leg portion and the second leg portion.

DETAILED DESCRIPTION OF THE INVENTION

Figure 1:
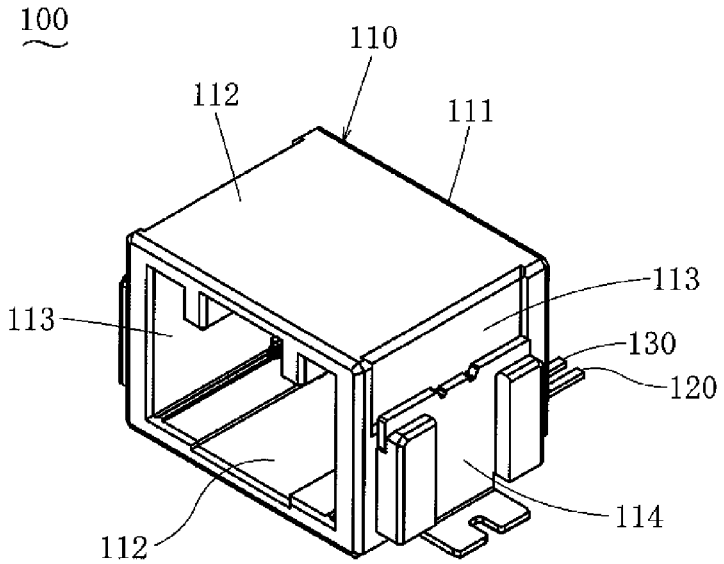
FIG. 1 is a perspective view of an electrical connector having terminals at different heights according to an embodiment of the present invention.
Figure 2:
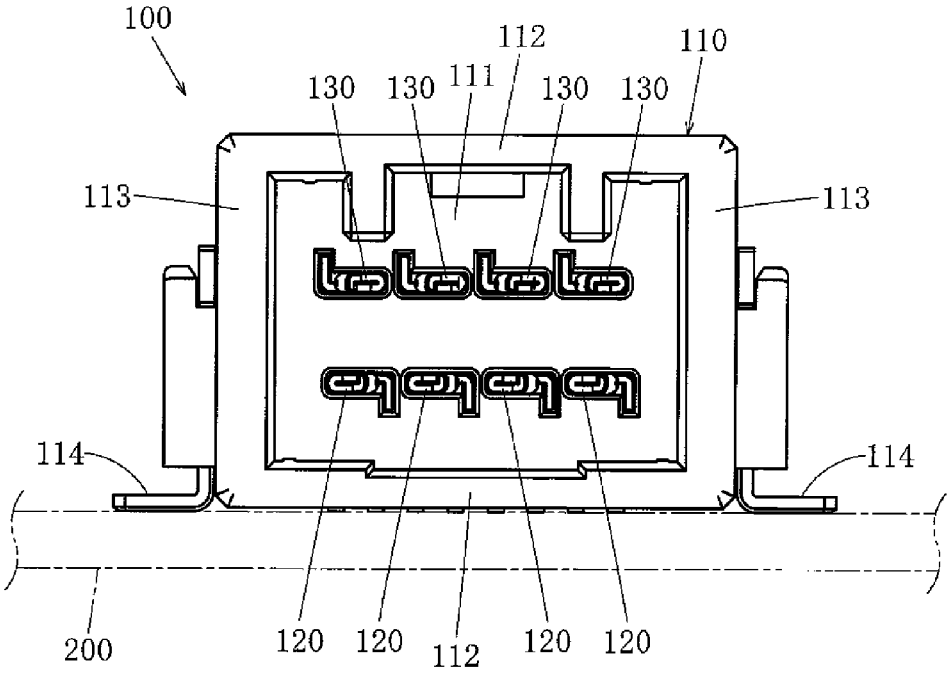
FIG. 2 is a front view of the electrical connector having terminals at different heights according to the embodiment.
Figure 3:
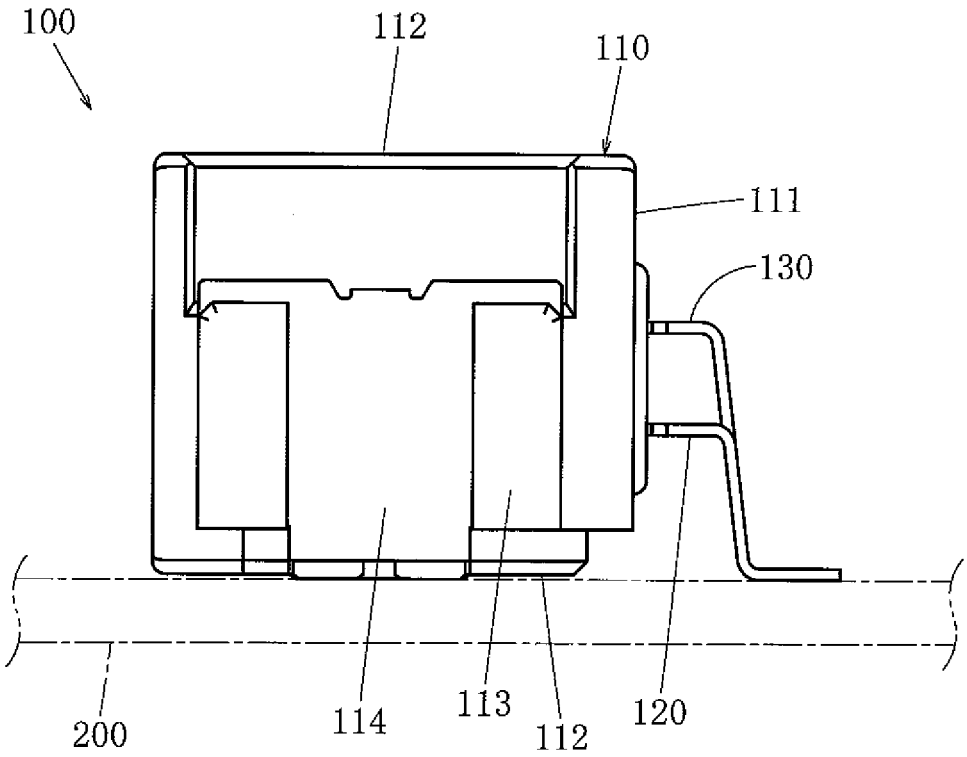
FIG. 3 is a side view of the electrical connector having terminals at different heights according to the embodiment.
Figure 4:
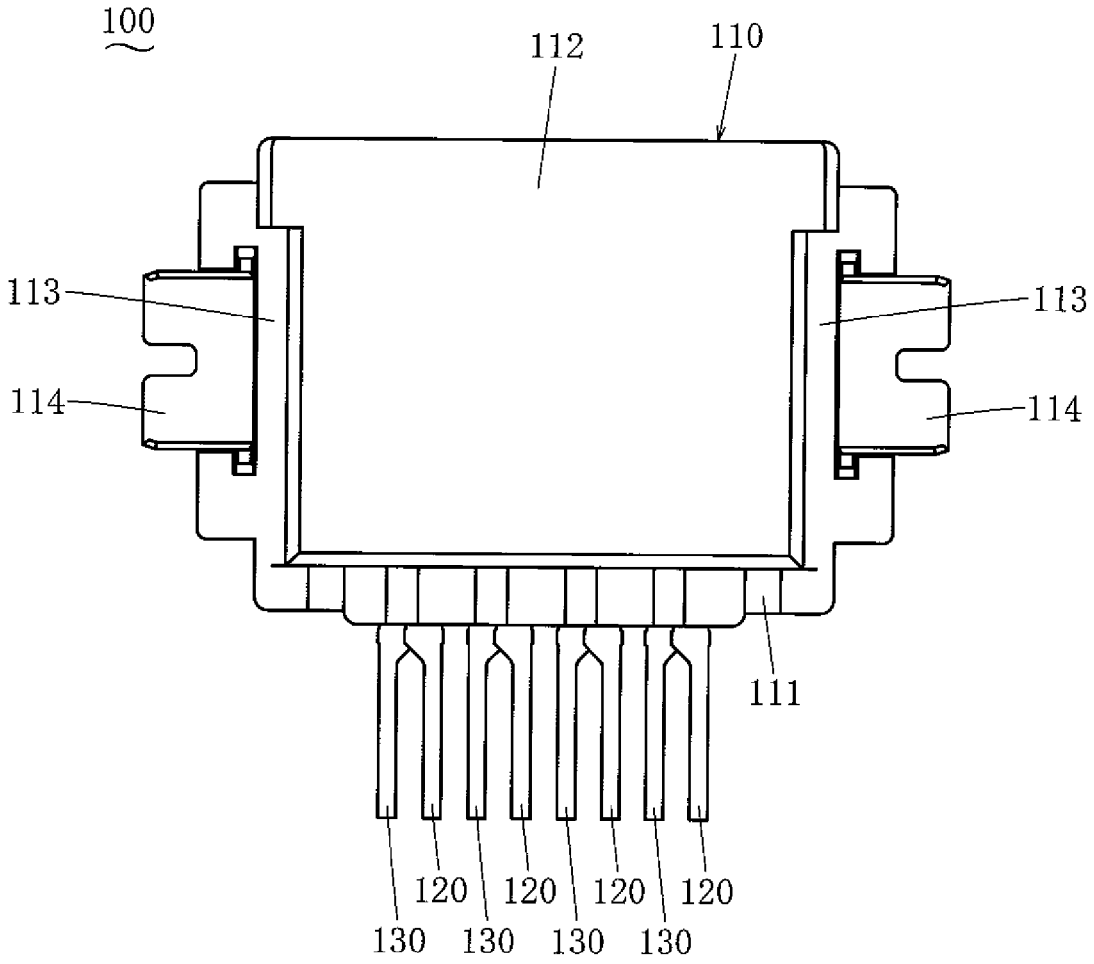
FIG. 4 is a bottom view of the electrical connector having terminals at different heights according to the embodiment.
Figure 5:
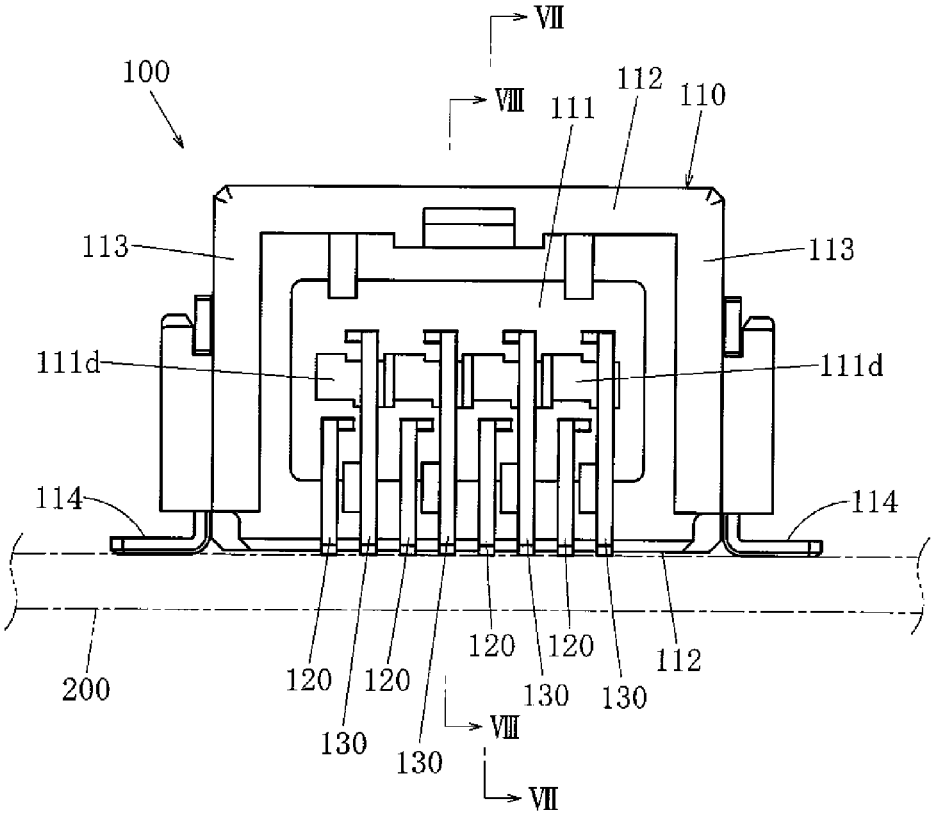
FIG. 5 is a rear view of the electrical connector having terminals at different heights according to the embodiment.
Figure 6:
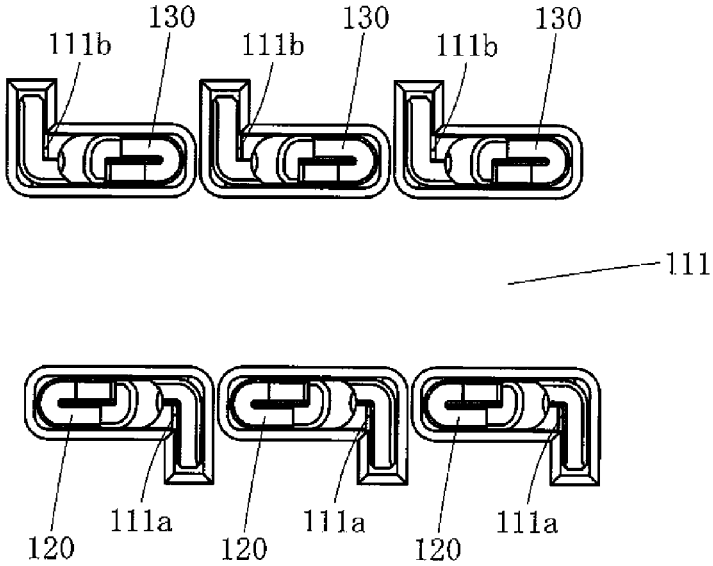
FIG. 6 is an enlarged view of a relevant portion of FIG. 2.

Embodiments of the present invention will be described below. FIGS. 1 to 19 show one embodiment of an electrical connector having terminals at different heights according to the present invention. Hereinafter, the electrical connector having terminals at different heights will be referred to as simply an electrical connector. An electrical connector 100 includes a housing 110, first terminals 120 provided on the housing 110, and second terminals 130 provided on the housing 110. The electrical connector 100 is mounted on a mounting target member 200. Although the electrical connector 100 is surface-mounted on a printed wiring board, that is to say the mounting target member 200, in this embodiment, the mounting target member may be an electrical product casing or other member. Also, the electrical connector can be an electrical connector having a mounting mode other than surface mounting, as long as it is a mounting mode in which co-planarity between terminals is required. A partner electrical connector (not shown) is mated to the electrical connector 100, and in this case, the mating side of the electrical connector 100 refers to the side of the electrical connector 100 that is mated to the partner electrical connector, and the counter mating side refers to the side opposite to the mating side. Also, the mating direction refers to the direction in which the electrical connector 100 is mated to the partner electrical connector. Furthermore, the height direction refers to a direction orthogonal to the mating direction, the mounting side refers to the side of the electrical connector 100 that is close to the mounting target member 200 in the height direction, and the counter mounting side refers to the side opposite to the mounting side. The height direction is unrelated to the vertical direction, and the height direction may form any angle with the vertical direction. The width direction is a direction that is orthogonal to the mating direction and the height direction. The electrical connector 100 is mounted to the mounting target member 200 such that the mating direction is parallel with the surface of the mounting target member 200, but the mating direction may form any angle with the surface of the mounting target member. Multiple first terminals and second terminals are provided in the width direction, the first terminals are arranged in a line in the width direction, and the second terminals are arranged in a line in the width direction. However, one or more first terminals may be provided in the width direction, and there is no requirement to be arranged in a line in the width direction. Also, one or more second terminals may be provided in the width direction, and there is no requirement to be arranged in a line in the width direction.

As shown in FIGS. 1 to 12, the housing 110 has a vertical wall 111 that faces the mating direction and rises from the mounting side of the housing 110 toward the counter mounting side along the height direction. The housing 110 is female-type, and is formed as a box that is open on the mating side. Also, the housing 110 is configured so as to receive the male-type housing of the partner electrical connector in its interior space. The housing 110 includes two horizontal walls 112 that face the height direction and oppose each other in the height direction, and two side walls 113 that face the width direction and oppose each other in the width direction, and the vertical wall 111 is arranged on the counter mating side of the horizontal walls 112 and the side walls 113, and is connected to them. 114 indicates reinforcing tabs provided on the side walls 113, and these reinforcing tabs 114 are soldered to the mounting target member. The present invention also encompasses an embodiment of an electrical connector that does not include these reinforcing tabs. Also, a configuration is possible in which the housing is male-type and received in the interior space of the female-type housing of the partner electrical connector. The vertical wall 111 is provided with first holes 111*a* that pass through the vertical wall 111 in the mating direction, and second holes 111*b* that pass through the vertical wall 111 in the mating direction farther on the counter mounting side than the first holes 111*a*. However, the configuration of the housing of the present invention is not intended to be limited to this embodiment, and it is sufficient that the housing of the present invention has the vertical wall that faces the mating direction and rises from the mounting side toward the counter mounting side along the height direction, and the vertical wall is provided with the first hole that passes through the vertical wall in the mating direction and the second hole that passes through the vertical wall in the mating direction farther on the counter mounting side than the first holes.

Figure 7:
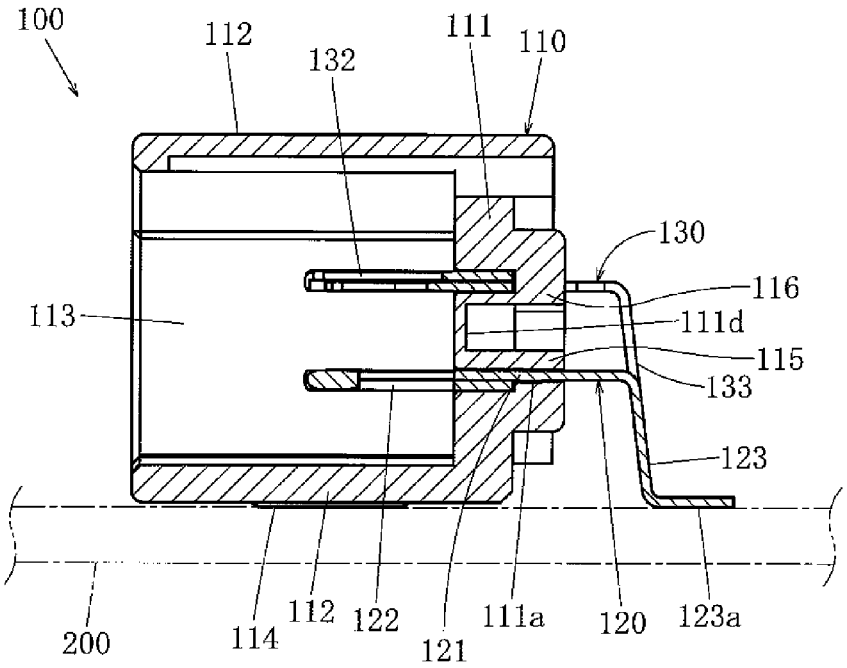
FIG. 7 is a cross-sectional view taken along line VII-VII in FIG. 5.

As shown in FIG. 7, the first terminal 120 includes a first press-fitting portion 121 that is fitted into a first hole 111*a*, a first contact portion 122 that protrudes from the first press-fitting portion 121 toward the mating side, and a first leg portion 123 that protrudes from the first press-fitting portion 121 toward the counter mating side and then extends toward the mounting side. As shown in FIGS. 13 to 17, the first terminal 120 is constituted by a plate-shaped member, but it may be constituted by a round bar or other shaped member, for example. The first press-fitting portion 121 is provided with a dimple 121*a* that protrudes in the height direction. The dimple 121*a* is formed by hitting a portion of the first press-fitting portion 121 from one side in the height direction such that the portion protrudes in the other direction, but it may be provided through padding or another method, for example. The present invention encompasses an embodiment in which the first terminal is not provided with the dimple. The first press-fitting portion 121 and the first contact portion 122 extend in the mating direction. The first leg portion 123 protrudes from the first press-fitting portion 121 toward the counter mating side, extends toward the mounting side, and then bends so as to face the counter mating side; the portion that faces the counter mating side is the mounting portion, and the surface on the mounting side is a mounting surface 123*a*. However, the configuration of the mounting portion of the first leg portion of the present invention is not intended to be limited to the above configuration, and a configuration is possible in which, for example, the first leg portion protrudes from the first press-fitting portion toward the counter mating side and then extends toward the mounting side, the end portion is the mounting portion, and the tip end thereof is the mounting surface. Although the first contact portion 122 is formed by folding over the plate-shaped member in the width direction, the configuration of the first contact portion of the present invention is not intended to be limited to this configuration, and a configuration is possible in which, for example, the first contact portion is formed by a plate member that is not folded over. As shown in FIGS. 13 to 17, the first press-fitting portion 121 and the first leg portion are formed in a straight line shape, and when the first terminal is inserted into the first hole 111*a*, the first press-fitting portion 121 is fitted into the first hole 111*a*, the first press-fitting portion 121 is brought into pressure contact with a wall surface that constitutes the first hole 111*a* in the vertical wall 111, and then the portion that is to be the first leg portion is bent relative to the first press-fitting portion. However, the procedure for attaching the first terminal of the present invention to the housing is not intended to be limited to this configuration, and a configuration is possible in which, for example, the portion that is to be the first leg portion is bent relative to the first press-fitting portion, and then the first press-fitting portion is fitted into the first hole.

Figure 8:
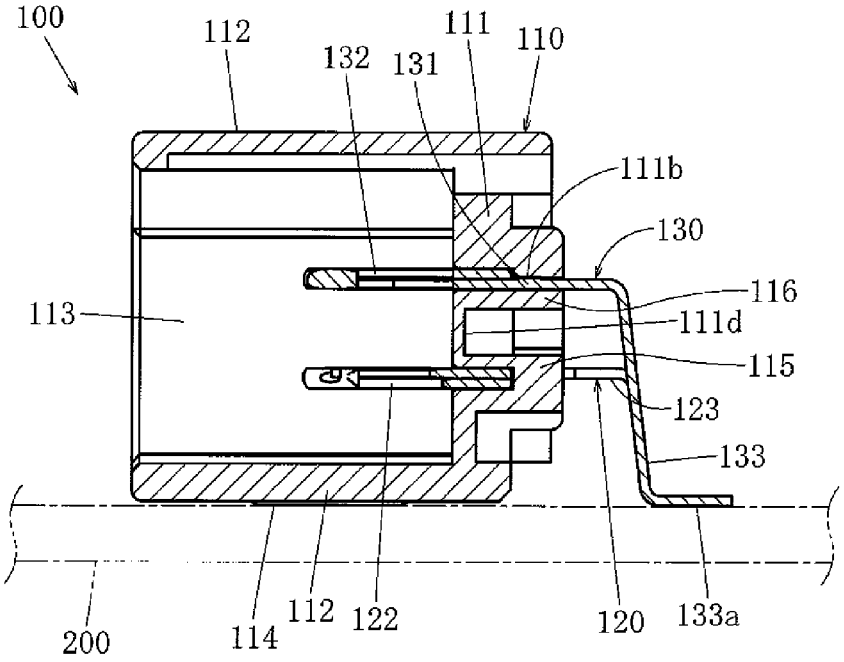
FIG. 8 is a cross-sectional view taken along line VIII-VIII in FIG. 5.
Figure 9:
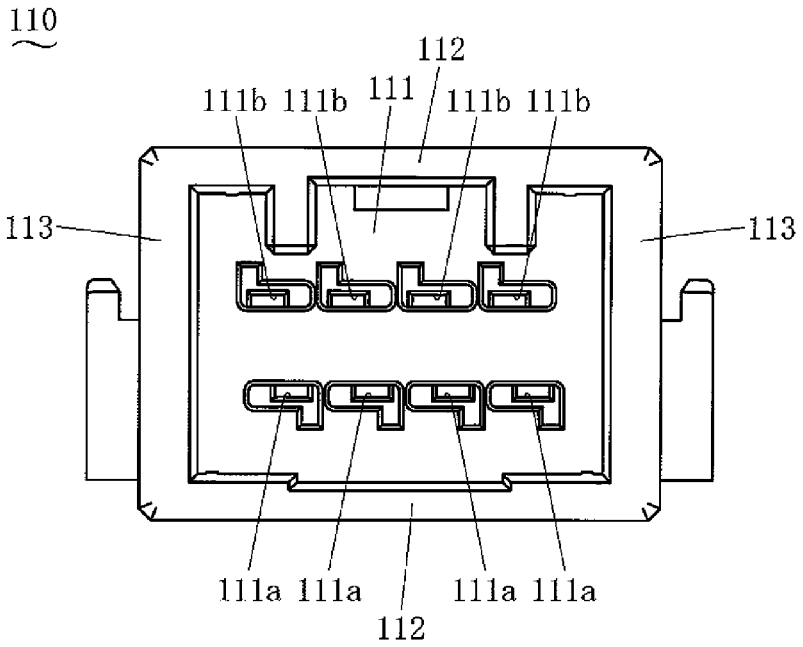
FIG. 9 is a front view of a housing of the electrical connector having terminals at different heights according to the embodiment
Figure 10:
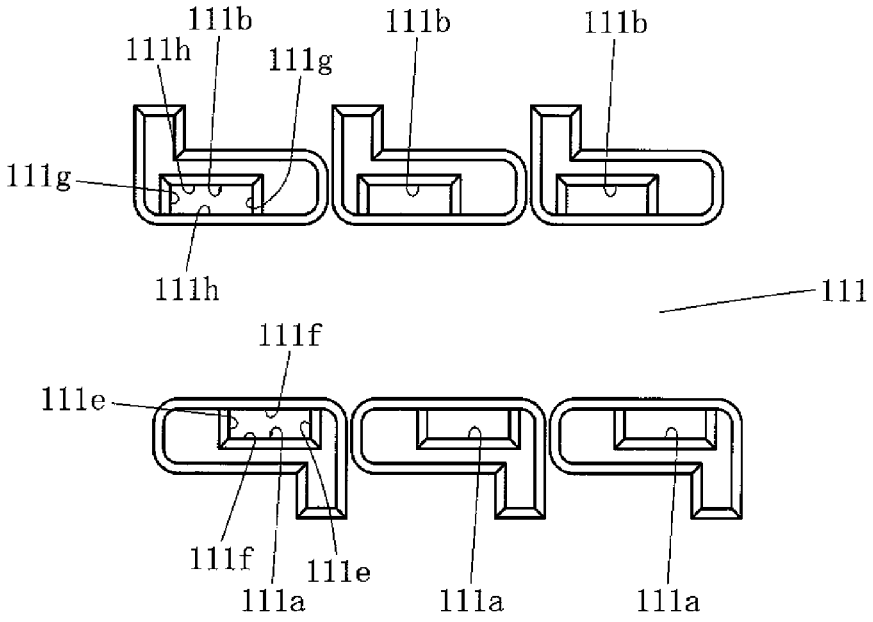
FIG. 10 is an enlarged view of a relevant portion of FIG. 9.
Figure 11:
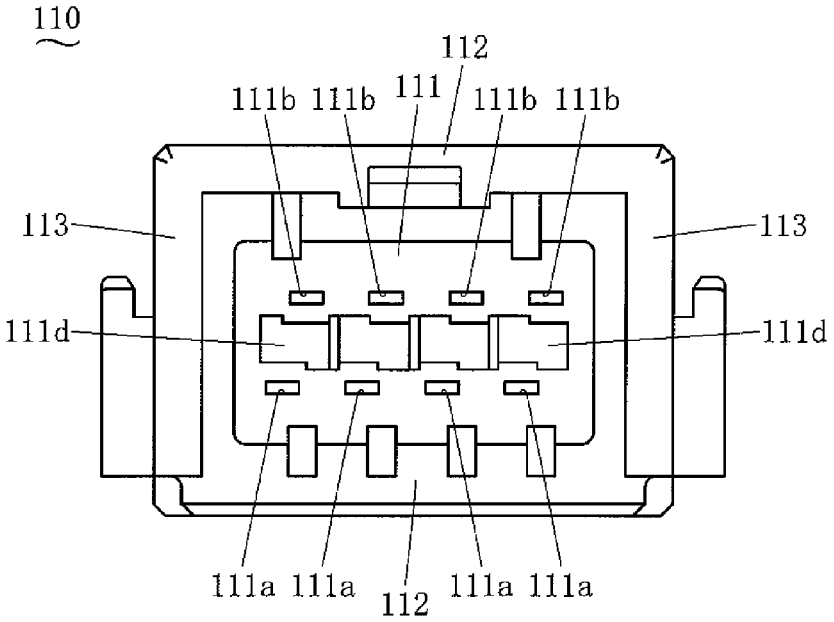
FIG. 11 is a rear view of the housing.
Figure 12:
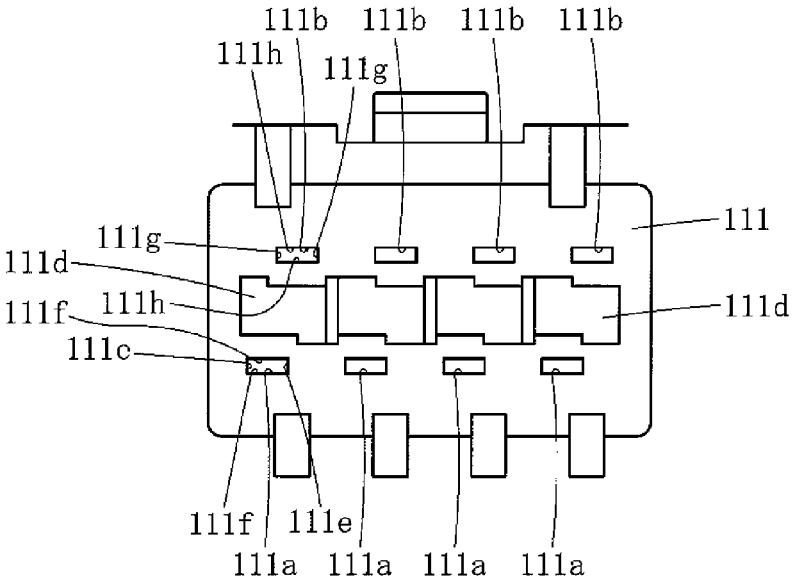
FIG. 12 is an enlarged view of a relevant portion of FIG. 11.
Figure 13:
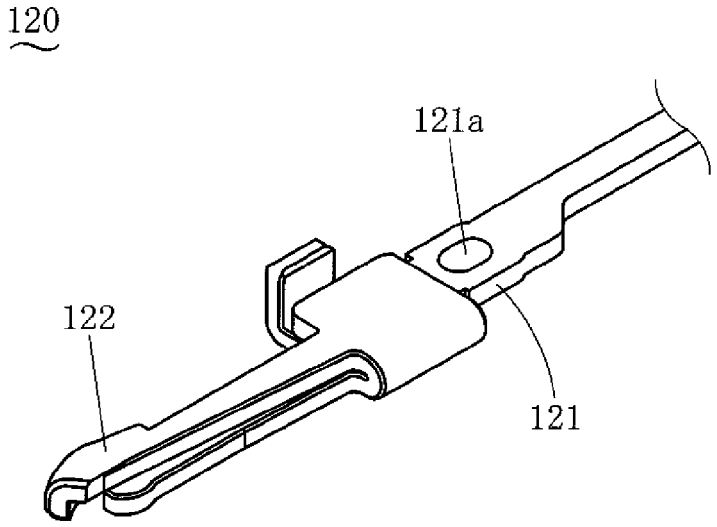
FIG. 13 is an enlarged perspective view of a first terminal and a second terminal of the electrical connector having terminals at different heights of the embodiment. A first leg portion and a second leg portion are shown in a state before bend processing.
Figure 14:
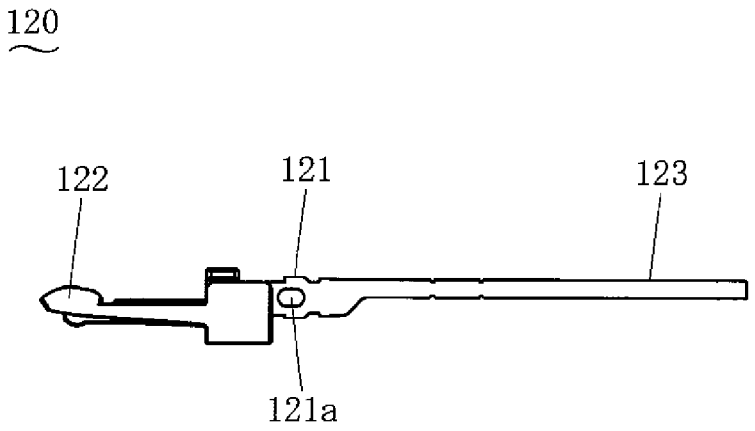
FIG. 14 is a bottom view of the first terminal and a plan view of the second terminal. The first leg portion and the second leg portion are shown in a state before bend processing.
Figure 15:
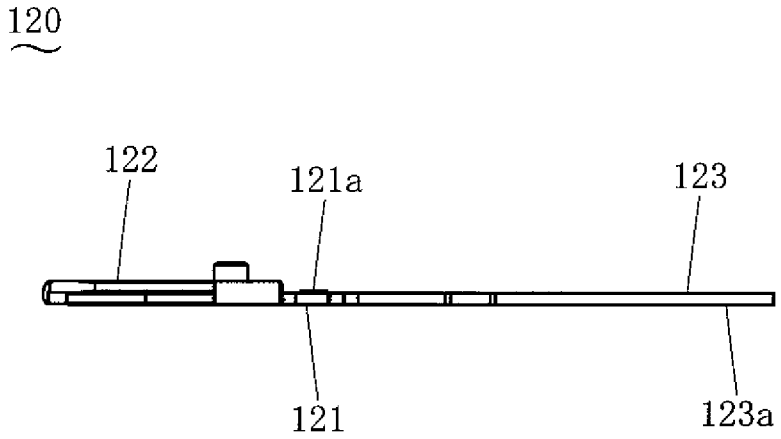
FIG. 15 is a side view of the first terminal and the second terminal. The first leg portion and the second leg portion are shown in a state before bend processing.
Figure 16:
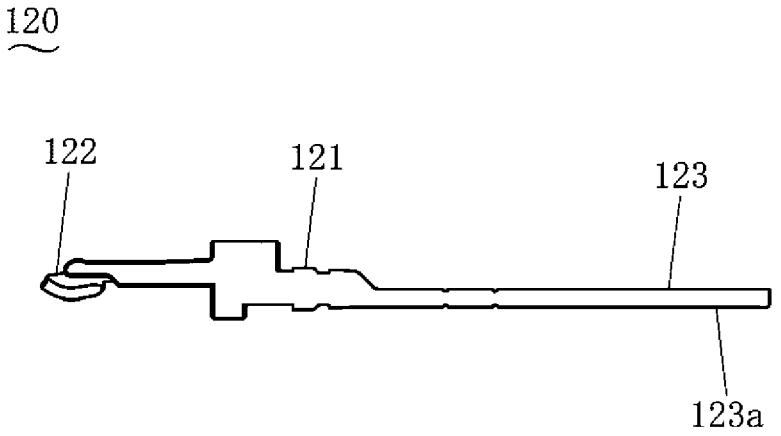
FIG. 16 is a plan view of the first terminal and a bottom view of the second terminal. The first leg portion and the second leg portion are shown in a state before bend processing.
Figure 17:
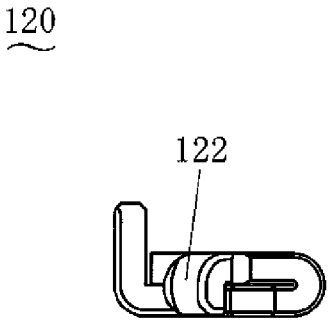
FIG. 17 is an enlarged front view of the first terminal and the second terminal. The first leg portion and the second leg portion are shown in a state before bend processing.

As shown in FIG. 8, the second terminal 130 includes a second press-fitting portion 131 that is fitted into a second hole 111*b*, a second contact portion 132 that protrudes from the second press-fitting portion 131 toward the mating side, and a second leg portion 133 that protrudes from the second press-fitting portion 131 toward the counter mating side and then extends toward the mounting side. As shown in FIGS. 13 to 17, the second terminal 130 is constituted by a plate-shaped member, but it may be constituted by a round bar or other shaped member, for example. The second press-fitting portion 131 is provided with a dimple 131*a* that protrudes in the height direction. The dimple 131*a* is formed by hitting a portion of the second press-fitting portion 131 from one side in the height direction such that the portion protrudes in the other direction, but it may be provided through padding or another method, for example. The present invention encompasses an embodiment in which the second terminal is not provided with the dimple. The second press-fitting portion 131 and the second contact portion 132 extend in the mating direction. The second leg portion 133 protrudes from the second press-fitting portion 131 toward the counter mating side, extends toward the mounting side, and then bends so as to face the counter mating side; the portion that faces the counter mating side is the mounting portion, and the surface on the mounting side is a mounting surface 133*a*. However, the configuration of the mounting portion of the second leg portion of the present invention is not intended to be limited to the above configuration, and a configuration is possible in which, for example, the second leg portion protrudes from the second press-fitting portion toward the counter mating side and then extends toward the mounting side, the end portion is the mounting portion, and the tip end thereof is the mounting surface. Although the second contact portion 132 is formed by folding over the plate-shaped member in the width direction, the configuration of the second contact portion of the present invention is not intended to be limited to this configuration, and a configuration is possible in which, for example, the second contact portion is formed by a plate member that is not folded over. As shown in FIGS. 13 to 17, the second press-fitting portion 131 and the second leg portion are formed in a straight line shape, and when the second terminal is inserted into the second hole 111*b*, the second press-fitting portion 131 is fitted into the second hole 111*b*, the second press-fitting portion 131 is brought into pressure contact with a wall surface that constitutes the second hole 111*b* in the vertical wall 111, and then the portion that is to be the second leg portion is bent relative to the second press-fitting portion. However, the procedure for attaching the second terminal of the present invention to the housing is not intended to be limited to this configuration, and a configuration is possible in which, for example, the portion that is to be the second leg portion is bent relative to the second press-fitting portion, and then the second press-fitting portion is fitted into the second hole.

The first terminal 120 and the second terminal 130 are obtained by processing a common member shown in FIGS. 13 to 17, one straight portion of the member is bent toward one side to form the first leg portion 123, and another straight portion is bent to the other side to form the second leg portion 133. However, the first terminal and the second terminal may be formed from separate members. The first terminals 120 and the second terminals 130 are arranged such that the first leg portions 123 and the second leg portions 133 are arranged alternatingly in a line with gaps in the width direction, and such that the positions of the mounting surfaces 123*a* and the mounting surfaces 133*a* are the same in the mating direction.

As shown in FIGS. 5, 7, 8, 11, and 12, a recessed portion 111*d* that is recessed from the counter mating side toward the mating side is provided between each pair of a first hole 111*a* and a second hole 111*b* in the vertical wall 111. The recessed portions 111*d* are a countermeasure for thinning-out or removing performed in order to prevent the formation of sinks (recessions, depressions, or the like formed due to material shrinkage) during molding of the housing 110. Generally, there are cases where sinks (i.e., recessions, depressions, or the like formed due to material shrinkage) are formed in the housing of an electrical connector during the molding thereof. In order to prevent the formation of these sinks, thinning-out or removal is performed to prevent the formation of thick portions in the housing. The recessed portions 111*d* are provided mainly as countermeasure for thinning-out or removal, but these recessed portion are also provided for weight reduction and other purposes as well, and the present invention is also directed to an electrical connector that includes a housing provided with these recessed portions as well. The housing 110 is molded using a synthetic resin material, but may be constituted by an insulating material that includes a synthetic resin material, or another material, or may be constituted by a composite material. Also, the housing 110 is molded by injection molding using a metal mold, but it may be formed using another molding method.

As shown in FIGS. 6, 10, 12, and 18, the first press-fitting portion 121 is press-fitted into the vertical wall 111 by coming into pressure contact with, among the wall surfaces that constitute the first hole 111*a* in the vertical wall 111, wall surfaces 111*e* on the two sides in the width direction. Out of two wall surfaces 111*f* on the two sides in the height direction among the wall surfaces that constitute the first hole 111*a* in the vertical wall 111, the first press-fitting portion 121 is in contact with the wall surface 111*f* on the counter mounting side, and is not in contact with the wall surface 111*f* on the mounting side. However, the first press-fitting portion does not need to be in contact with the wall surfaces on the two sides in the height direction among the wall surfaces that constitute the first hole in the vertical wall, or may be in contact with at least one of them, and in the latter case, the first press-fitting portion may be in contact with the wall surface without pressure, or may be in contact with the wall surface with an amount of pressure that does not correspond to press-fitting.

As shown in FIGS. 6, 10, 12, and 19, the second press-fitting portion 131 is press-fitted into the vertical wall 111 by coming into pressure contact with, among the wall surfaces that constitute the second hole 111*b* in the vertical wall 111, wall surfaces 111*g* on the two sides in the width direction and wall surfaces 111*h* on the two sides in the height direction.

Figure 19:
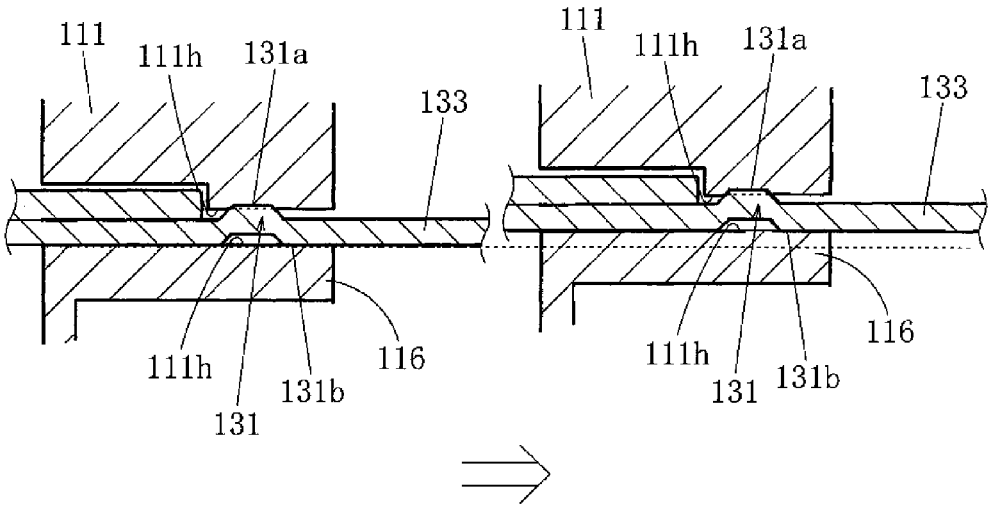
FIG. 19 is an enlarged cross-sectional view of the behavior of the second terminal in the housing. The left side of the figure shows the state at room temperature, and the right side of the figure shows the state when heat is received from a heating means such as a reflow soldering apparatus.

As shown in FIG. 19, a flat surface 131*b* that comes into contact with, out of the wall surfaces 111*h* on the two sides in the height direction among the wall surfaces that constitute the second hole 111*b* in the vertical wall 111, the wall surface 111*h* on the mounting side, is formed on the mounting side of the second press-fitting portion 131.

Figure 18:
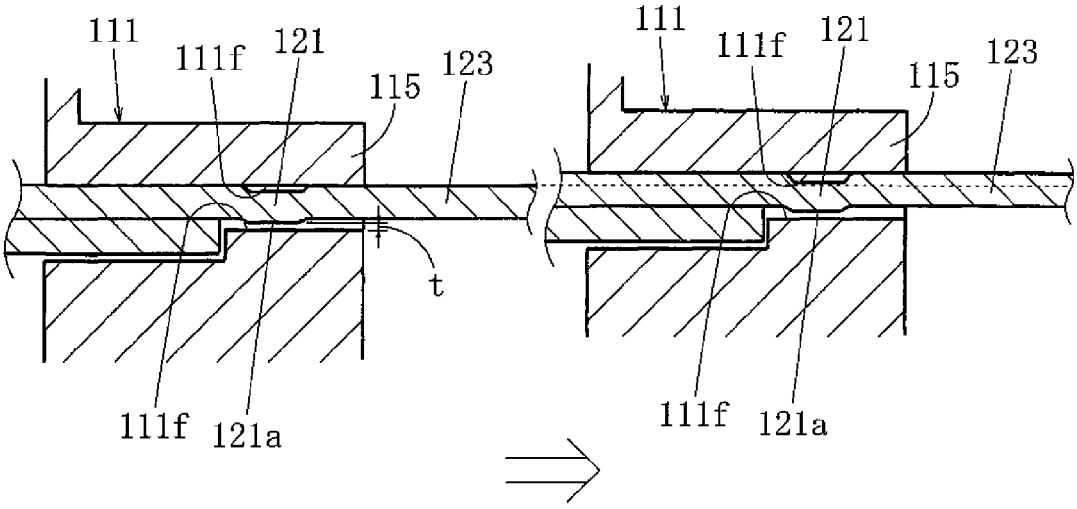
FIG. 18 is an enlarged cross-sectional view of the behavior of the first terminal in the housing. The left side of the figure shows the state at room temperature, and the right side of the figure shows the state when heat is received from a heating means such as a reflow soldering apparatus.

As shown in FIG. 18, a gap t is formed between the first press-fitting portion 121 and the mounting side wall surface 111*f* out of the two wall surfaces 111*f* on the two sides in the height direction among the wall surfaces that constitute the first hole 111*a* in the vertical wall 111. This gap may be formed between the first press-fitting portion and the wall surface on counter mounting side among the wall surfaces that constitute the first hole in the vertical wall, or the gap may be formed both between the first press-fitting portion and the wall surface on the mounting side among the wall surfaces that constitute the first hole in the vertical wall, and between the first press-fitting portion and the wall surface on the counter mounting side.

Figure 20:
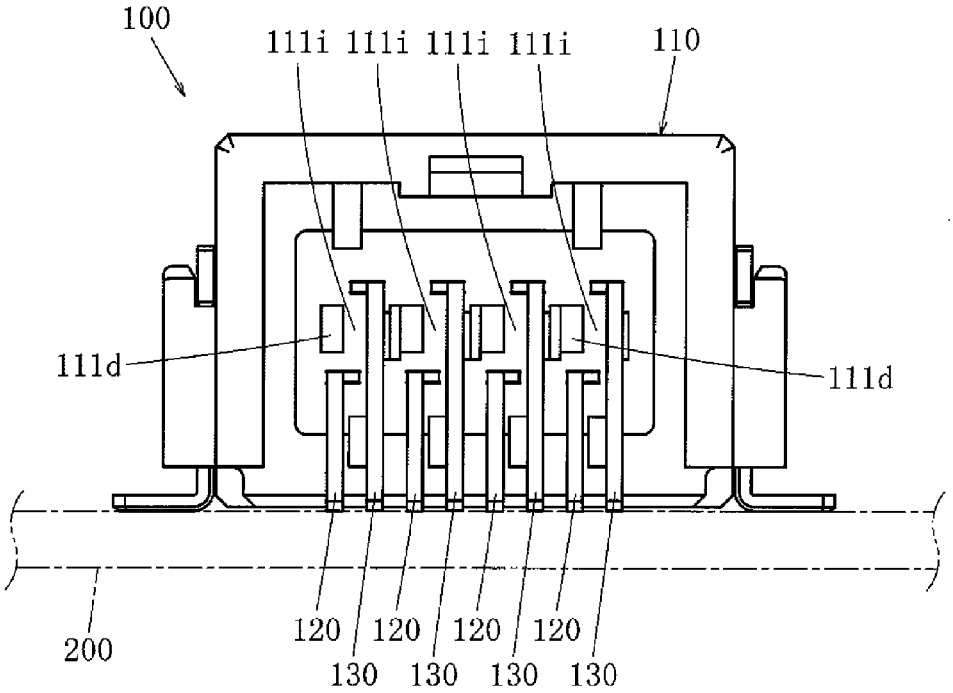
FIG. 20 is a rear view of an electrical connector having terminals at different heights according to a first variation.
Figure 21:
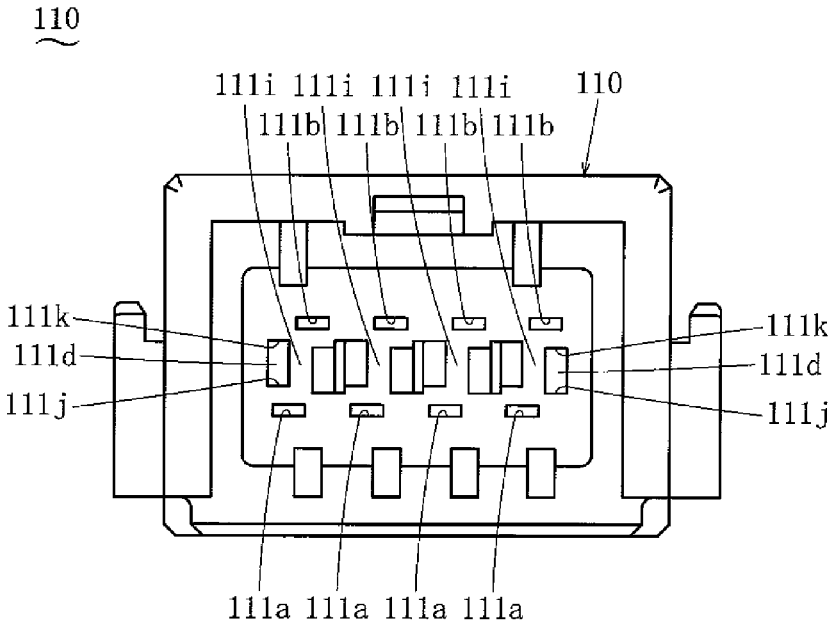
FIG. 21 is a rear view of a housing of the electrical connector having terminals at different heights according to the first variation.

FIGS. 20 and 21 show an electrical connector 100 according to a first variation of the above embodiment. In the case of this electrical connector 100, ribs 111*i* that connect, out of the wall surfaces that constitute the recessed portion 111*d* in the vertical wall 111, a wall surface 111*j* on the mounting side and a wall surface 111*k* on the counter mounting side, are provided in correspondence with at least one out of the first holes 111*a* and the second holes 111*b*. In the case of this embodiment, the ribs 111*i* are provided between the first holes 111*a* and the second holes 111*b* with respect to the width direction, and are provided in correspondence with the first holes 111*a* and the second holes 111*b*, but they may be provided in correspondence with either the first holes or the second holes. Also, in the case where at least one out of the first hole and the second hole is provided in plurality in the width direction as in the above embodiment, multiple ribs may be provided in correspondence with the multiple first holes or second holes, or may be provided in correspondence with only a portion of the first holes or second holes.

Figure 22:
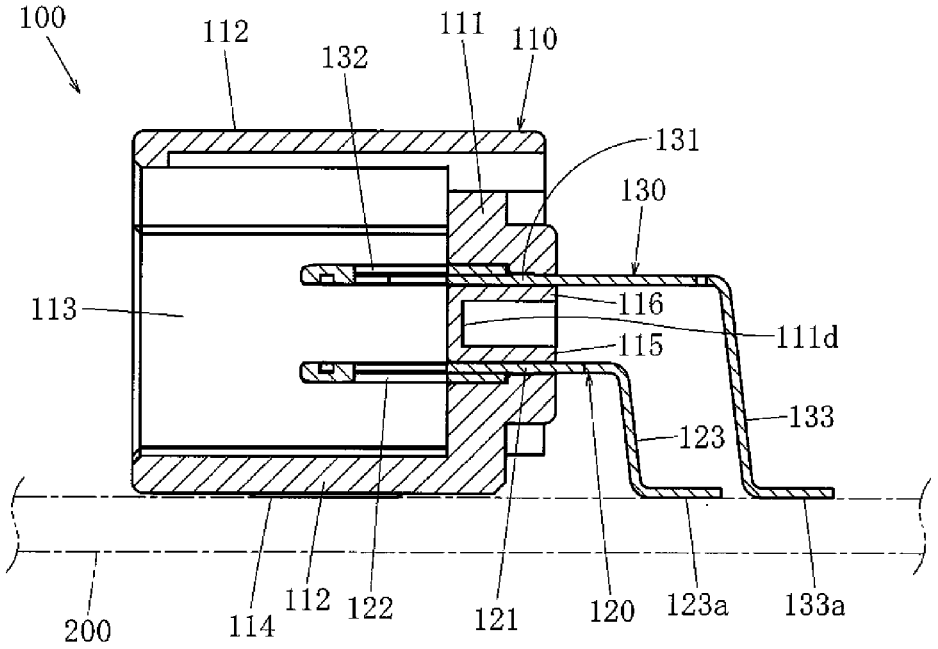
FIG. 22 is a cross-sectional view of an electrical connector having terminals at different heights according to a second variation.

FIG. 22 shows an electrical connector 100 according to a second variation of the above embodiment. In the case of this electrical connector 100, the first terminals 120 and the second terminals 130 are arranged such that corresponding first leg portions 123 and second leg portions 133 are at the same position in the width direction, and the mounting surfaces 123*a* and the mounting surfaces 133*a* are shifted in the mating direction. If the first terminals 120 and the second terminals 130 are arranged as in the above embodiment, the mating direction dimension of the electrical connector 100 can be set relatively short, but if the first terminals 120 and the second terminals 130 are arranged as in the electrical connector 100 of the present second variation, the width direction dimension of the electrical connector 100 can be set relatively short.

Figure 23:
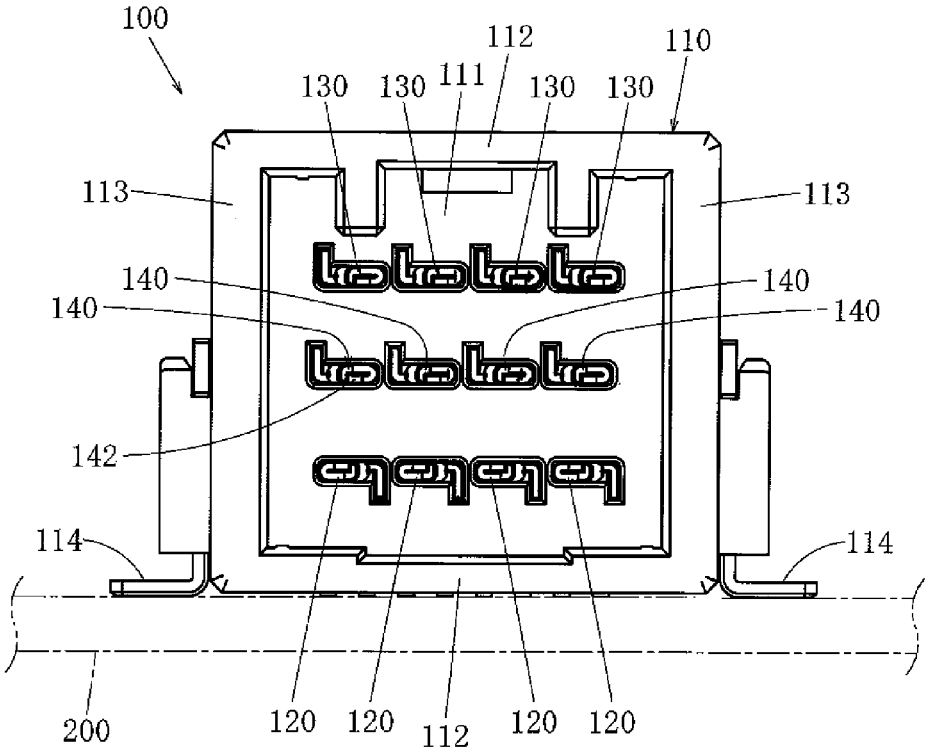
FIG. 23 is a front view of an electrical connector having terminals at different heights according to a third variation.
Figure 24:
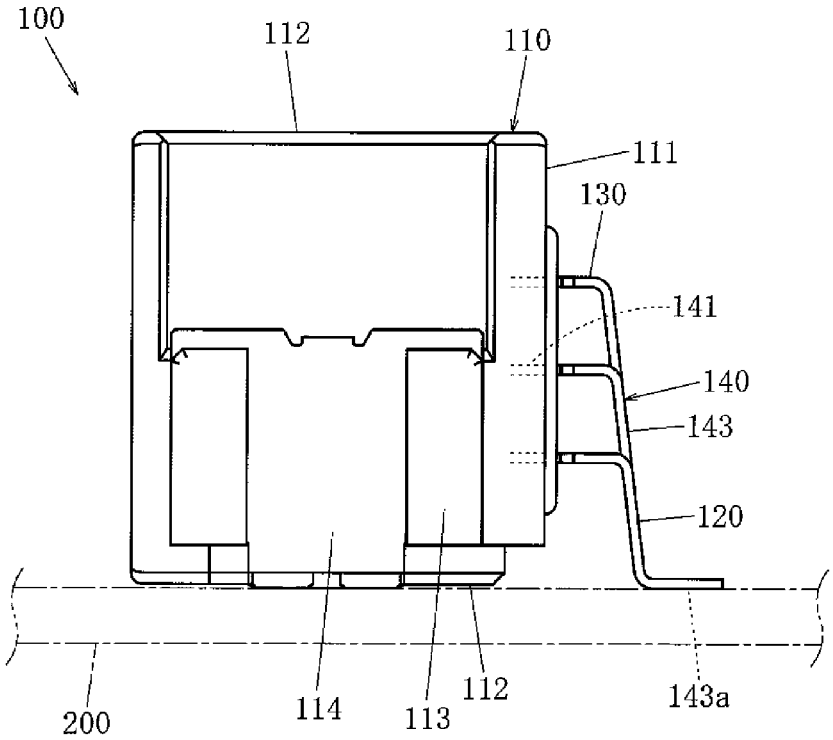
FIG. 24 is a side view of the electrical connector having terminals at different heights according to the third variation.
Figure 25:
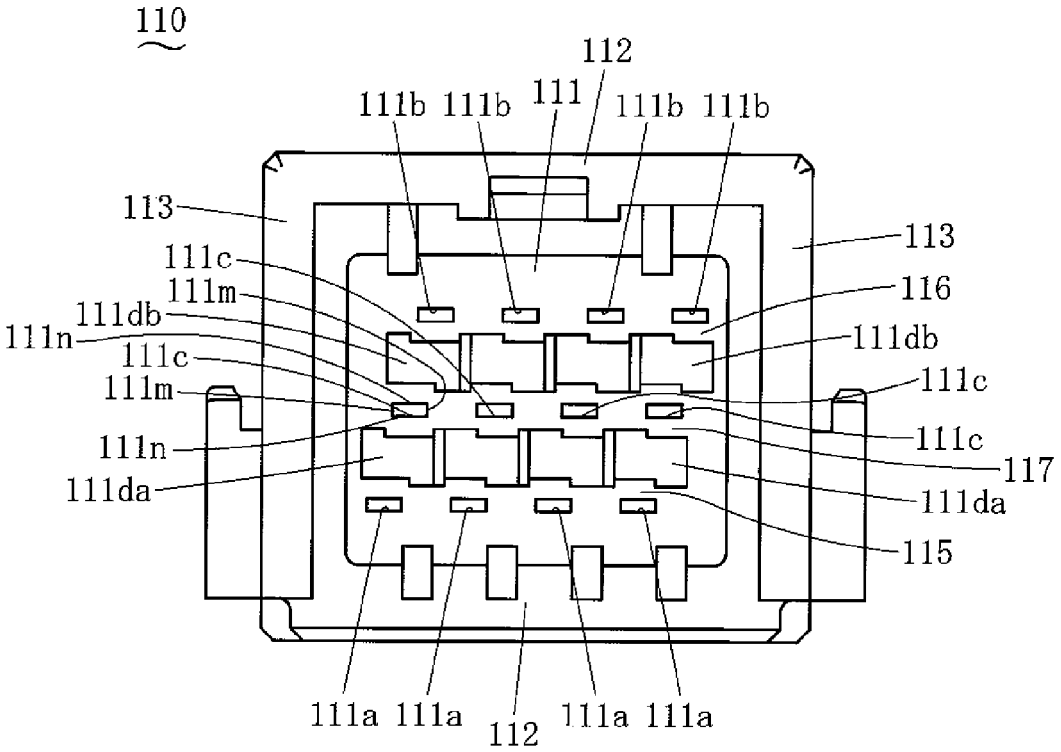
FIG. 25 is a rear view of a housing of the electrical connector having terminals at different heights according to the third variation.
Figure 26:
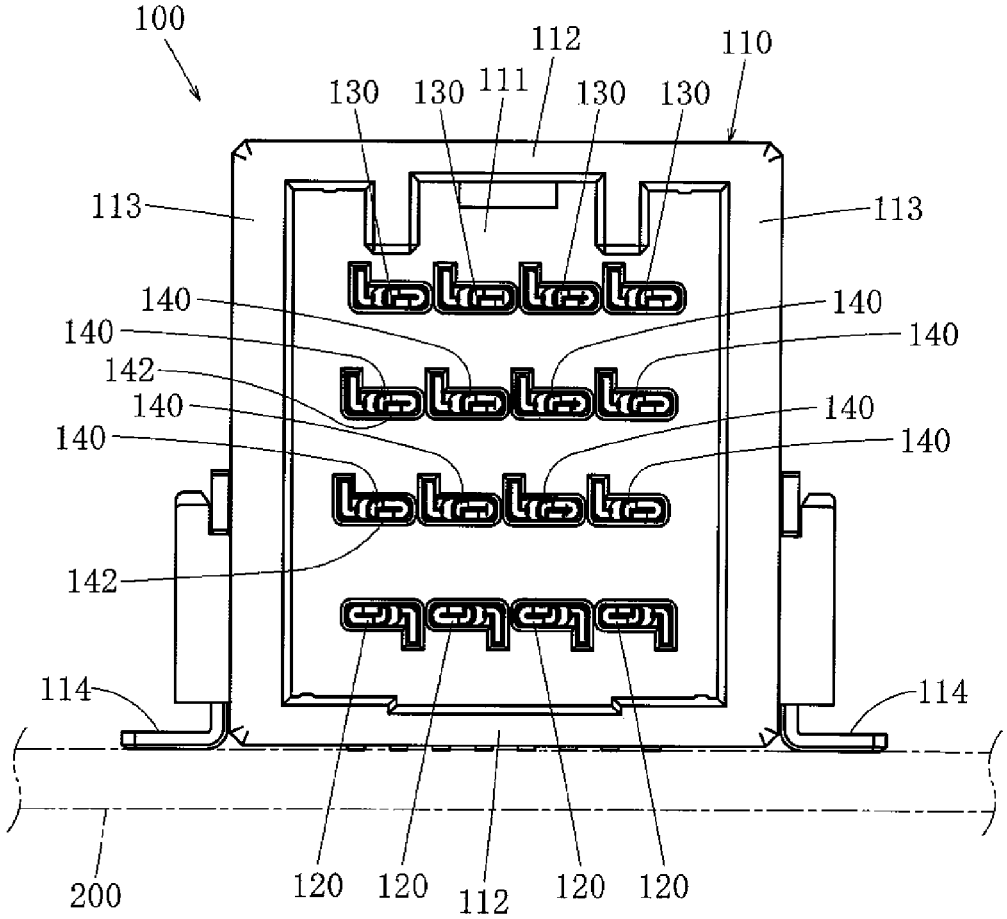
FIG. 26 is a front view of an electrical connector having terminals at different heights according to a fourth variation.
Figure 27:
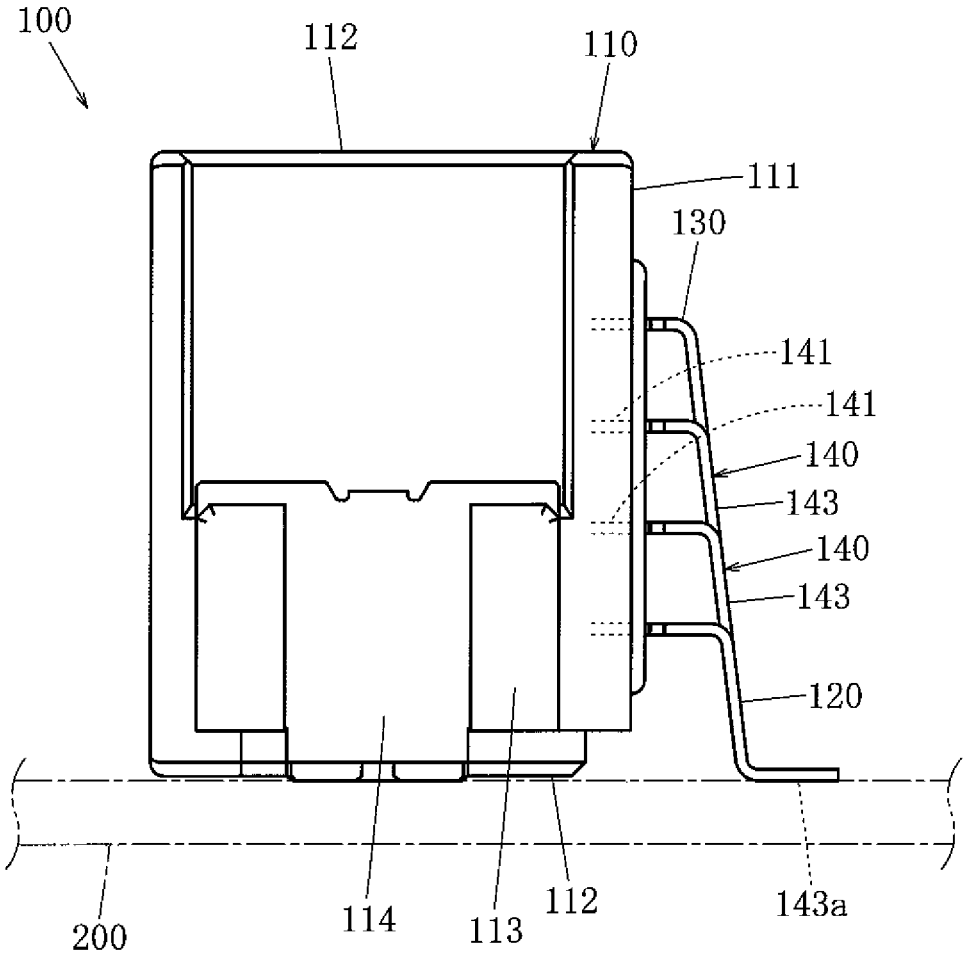
FIG. 27 is a side view of the electrical connector having terminals at different heights according to the fourth variation.
Figure 28:
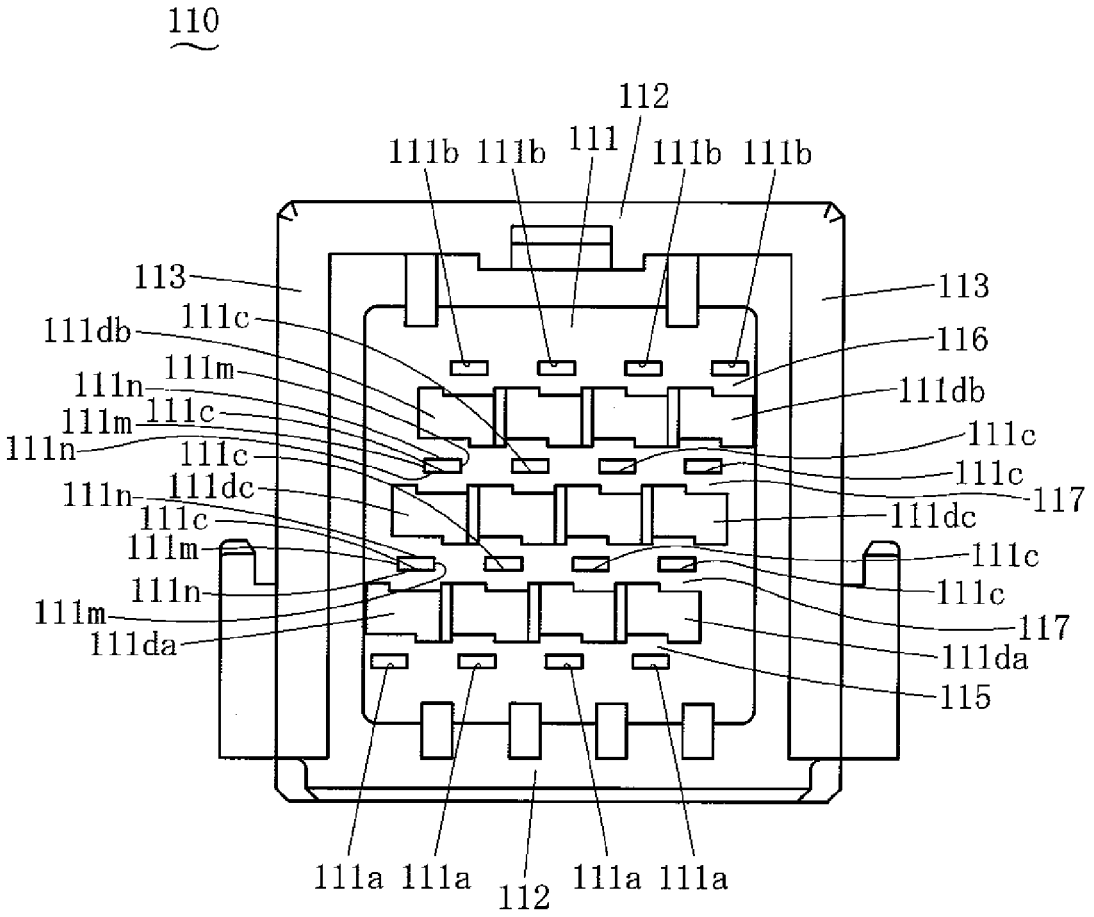
FIG. 28 is a rear view of a housing of the electrical connector having terminals at different heights according to the fourth variation.

FIGS. 23 to 25 show an electrical connector 100 according to a third variation of the above embodiment. Also, FIGS. 26 to 28 show an electrical connector 100 according to a fourth variation of the above embodiment. In the case of these electrical connectors 100, one third hole 111*c* that passes through the vertical wall 111 in the mating direction or two or more third holes 111*c* that are separated in the height direction and pass through the vertical wall 111 in the mating direction are provided on the counter mounting side relative to the first holes 111*a* and on the mounting side relative to the second holes 111*b* in the vertical wall 111. Furthermore, the same number of third terminals 140 as the number of third holes 111*c* is provided. In this case of these embodiments, a first hole 111*a* and a first terminal 120 form a pair with a second hole 111*b* and a second terminal 130, and a third hole 111*c* and a third terminal 140 are provided for each of these pairs. In the case of the electrical connector 100 of the third variation, one third hole 111*c* and one third terminal 140 are provided for each of the above pairs, and in the case of the electrical connector 100 of the fourth variation, two third holes 111*c* and two third terminals 140 separated in the height direction are provided for each pair. Alternatively, three or more third holes and three or more third terminals separated in the height direction may be provided for each pair. Since there are multiple pairs as described above, multiple third holes 111*c* and multiple third terminals 140 are provided. In contrast, a configuration is possible in which a first hole and a first terminal do not form a pair with a second hole and a second terminal, and a third hole 111*c* and a third terminal 140 are provided without corresponding to the above pairs.

Each third terminal 140 includes a third press-fitting portion 141 that is fitted into a third hole 111*c*, a third contact portion 142 that protrudes from the third press-fitting portion 141 toward the mating side, and a third leg portion 143 that protrudes from the third press-fitting portion 141 toward the counter mating side and then extends toward the mounting side. As shown in FIGS. 13 to 17, the third terminal 140 is constituted by a plate-shaped member, but it may be constituted by a round bar or other shaped member, for example. The third press-fitting portion 141 is provided with a dimple that protrudes in the height direction. This dimple is formed by hitting a portion of the third press-fitting portion 141 from one side in the height direction such that the portion protrudes in the other direction, but it may be provided through padding or another method, for example. The present invention encompasses an embodiment in which the third terminal is not provided with the dimple. The third press-fitting portion 141 and the third contact portion 142 extend in the mating direction. The third leg portion 143 protrudes from the third press-fitting portion 141 toward the counter mating side, extends toward the mounting side, and then bends so as to face the counter mating side; the portion that faces the counter mating side is the mounting portion, and the surface on the mounting side is a mounting surface 143*a*. However, the configuration of the mounting portion of the third leg portion of the present invention is not intended to be limited to the above configuration, and a configuration is possible in which, for example, the third leg portion protrudes from the third press-fitting portion toward the counter mating side and then extends toward the mounting side, the end portion is the mounting portion, and the tip end thereof is the mounting surface. Although the third contact portion 142 is formed by folding over the plate-shaped member in the width direction, the configuration of the third contact portion of the present invention is not intended to be limited to this configuration, and a configuration is possible in which, for example, the third contact portion is formed by a plate member that is not folded over. As shown in FIGS. 13 to 17, the third press-fitting portion 141 and the third leg portion are formed in a straight line shape, and when the third terminal is inserted into the third hole 111*c*, the third press-fitting portion 141 is fitted into the third hole 111*c*, the third press-fitting portion 141 is brought into pressure contact with a wall surface of the vertical wall 111 that constitutes the third hole 111*c*, and then the portion that is to be the third leg portion is bent relative to the third press-fitting portion. However, the procedure for attaching the third terminal of the present invention to the housing is not intended to be limited to this configuration, and a configuration is possible in which, for example, the portion that is to be the third leg portion is bent relative to the third press-fitting portion, and then the third press-fitting portion is fitted into the third hole.

In the case of the electrical connector 100 of the third variation, as shown in FIG. 25, each of the recessed portions 111*d* is divided into a first recessed portion 111*da* that is provided between the first hole 111*a* and the third hole 111*c* in the vertical wall 111, and a second recessed portion 111*db* that is provided between the third hole 111*c* and the second hole 111*b* in the vertical wall 111. In the case of the electrical connector 100 of the fourth variation, as shown in FIG. 28, each of the recessed portions 111*d* is divided into a first recessed portion 111*da* that is provided between the first hole 111*a* and the third hole 111*c* closest to the mounting side in the vertical wall 111, a second recessed portion 111*db* that is provided between the third hole 111*c* closest to the counter mounting side and the second hole 111*b* in the vertical wall 111, and a third recessed portion 111*dc* that is provided between third holes 111*c* that are adjacent in the height direction in the vertical wall 111. If three or more third holes and three or more third terminals separated in the height direction are provided for each of the pairs as described above, the above recessed portion is divided into four or more recessed portions. The third press-fitting portion 141 is press-fitted into the vertical wall 111 by coming into pressure contact with, among the wall surfaces that constitute the third hole 111*c* in the vertical wall 111, wall surfaces on the two sides in the width direction and wall surfaces on the two sides in the height direction. This is similar to the case of the second press-fitting portions 131 shown in FIGS. 6, 10, 12, and 19. Similarly to the electrical connector 100 of the first variation, the above-described ribs may be provided in the electrical connector 100 of the third variation and the electrical connector 100 of the fourth variation as well. Specifically, in the case of these electrical connectors 100, among the wall surfaces that constitute at least one recessed portion out of the first recessed portion 111*da*, the second recessed portion 111*db* and the third recessed portion 111*dc* in the vertical wall 111, a rib that connects the wall surface on the mounting side and the wall surface on the counter mounting side may be provided in correspondence with at least one of the first hole, the second hole, and the third hole. In this case, it is possible to obtain the same operations and effects as the operations and effects of the ribs 111*i* in the case of the electrical connector 100 of the first variation. Also, in the case where two or more of at least one of the first hole, the second hole, and the third hole are provided in the width direction as with the electrical connectors 100 of the third variation and the fourth variation, two or more ribs may be provided in correspondence with the two or more first holes, second holes, or third holes, or the rib may be provided in correspondence with only a portion of the first holes, second holes, or third holes. Also, similarly to the electrical connector 100 of the above embodiment, a flat surface may be provided on at least one out of the second press-fitting portions and the third press-fitting portions in the electrical connector 100 of the third variation and the electrical connector 100 of the fourth variation as well. Specifically, in the case of these electrical connectors 100, the flat surface 131*b* that comes into contact with, out of the wall surfaces 111*h* on the two sides in the height direction among the wall surfaces that constitute the second hole 111*b* in the vertical wall 111, the wall surface 111*h* on the mounting side, may be formed on the mounting side of the second press-fitting portion 131. Also, a flat surface that comes into contact with, out of the wall surfaces on the two sides in the height direction among the wall surfaces that constitute the third hole 111*c* in the vertical wall 111, a wall surface 111*n* on the mounting side, may be formed on the mounting side of the third press-fitting portion 141. In this case, it is possible to obtain the same operations and effects as the operations and effects of the flat surface 131*b* in the case of the electrical connector 100 of the above embodiment.

The pressure between the third press-fitting portion 141 and the wall surfaces on the two sides in the height direction among the wall surfaces that constitute the third hole 111*c* in the vertical wall 111, and the pressure between the second press-fitting portion 131 and the wall surfaces 111*h* on the two sides in the height direction among the wall surfaces that constitute the second hole 111*b* in the vertical wall 111 are set so as to be higher the closer the press-fitting portion is to the counter mounting side.

Accordingly, in the electrical connector 100 of the above embodiment and the variations thereof, when the housing 110 without the first terminal 120 and the second terminal 130 press-fitted therein receives heat from a heating means such as a reflow soldering apparatus, due to thermal deformation, a wall 115 between the recessed portion 111*d* and the first hole 111*a* becomes inclined such that the tip of the wall 115 on the counter mating side moves closer to the mounting side than the mating side portion, and a wall 116 between the recessed portion 111*d* and the second hole 111*b* becomes inclined such that the tip of the wall 116 on the counter mating side moves closer to the counter mounting side than the mating side portion, and the inclination of the wall 116 between the recessed portion 111*d* and the second hole 111*b* tends to be larger than the inclination of the wall 115 between the recessed portion 111*d* and the first hole 111*a*. For this reason, if the press-fitting of the first press-fitting portion 121 into the vertical wall 111 and the press-fitting of the second press-fitting portion 131 into the vertical wall 111 are performed under the same conditions, deviation occurs between height direction displacement of the first leg portion 123 and the second leg portion 133, and this impairs the co-planarity of the first leg portion 123 and the second leg portion 133. However, in the case of the electrical connector 100, as shown in FIG. 18, in the press-fitting of first press-fitting portion 121, pressure is not applied to the wall surfaces 111*f* on the two sides in the height direction among the wall surfaces that constitute the first hole 111*a* in the vertical wall 111, and therefore the comparatively small inclination of the wall 115 between the recessed portion 111*d* and the first hole 111*a* is kept approximately the same. On the other hand, as shown in FIG. 19, in the press-fitting of the second press-fitting portion 131, pressure is applied to the wall surfaces 111*h* on the two sides in the height direction among the wall surfaces that constitute the second hole 111*b* in the vertical wall 111, and therefore due to this pressure, the wall 116 between the recessed portion 111*d* and the second hole 111*b* is pressed toward the mounting side, and the inclination thereof decreases. This suppresses the case where the second leg portion 133 becomes more displaced toward the counter mounting side than the first leg portion 123, thus raising the possibility of obtaining favorable co-planarity between the first leg portion 123 and the second leg portion 133. Also, in the press-fitting of the first press-fitting portion 121, pressure is not applied to the wall surfaces 111*f* on the two sides in the height direction among the wall surfaces that constitute the first hole 111*a* in the vertical wall 111, and therefore the wall 115 between the recessed portion 111*d* and the first hole 111*a* is not pressed toward the mounting side by pressure in the press-fitting. This reduces the risk of an increase in the size of the gap in the height direction between the first leg portion 123 and the second leg portion 133, and reduces the risk of impairing the co-planarity of the first leg portion 123 and the second leg portion 133. In this way, with the electrical connector 100, the first press-fitting portion 121 is press-fitted into the vertical wall 111 by the first press-fitting portion 121 coming into pressure contact with the wall surfaces 111*e* on the two sides in the width direction among the wall surfaces that constitute the first hole 111*a* in the vertical wall 111, and the second press-fitting portion 131 is press-fitted into the vertical wall 111 by the second press-fitting portion 131 coming into pressure contact with, among the wall surfaces that constitute the second hole 111*b* in the vertical wall 111, the wall surfaces 111*g* on the two sides in the width direction and the wall surfaces 111*h* on the two sides in the height direction, and thus it is possible to raise the possibility of obtaining favorable co-planarity between the first leg portion 123 and the second leg portion 133, and to suppress soldering defects in the electrical connector 100. In FIGS. 18 and 19, when moving from the room temperature state shown on the left side to the heated state shown on the right side, the entirety of the first terminal 120 and the second terminal 130 move toward the counter mounting side, and this is because the housing 110 has undergone thermal deformation.

In the above-described electrical connector of the present invention, there are no limitations on the shape of surface of the second press-fitting portion on the mounting side. Among various embodiments, in the case of the electrical connector 100 of the above embodiment and variations thereof, the flat surface 131*b* that comes into contact with, out of the wall surfaces 111*h* on the two sides in the height direction among the wall surfaces that constitute the second hole 111*b* in the vertical wall 111, the wall surface 111*h* on the mounting side, is formed on the mounting side of the second press-fitting portion 131. According to this configuration, when the wall 116 between the recessed portion 111*d* and the second hole 111*b* is pressed toward the mounting side due to the pressure in the press-fitting of the second terminal 130, pressure is likely to be uniformly applied to the wall 116, and thus inclination of the wall 116 is uniformly suppressed, and there is an even higher possibility of obtaining favorable co-planarity between the first leg portion 123 and the second leg portion 133.

In the above-described electrical connector of the present invention, there are no limitations on the mode of contact between the first press-fitting portion and the wall surfaces that constitute the first hole in the vertical wall. The present invention encompasses an embodiment of the electrical connector in which, for example, all of the surfaces of the first press-fitting portion come into contact with the wall surfaces that constitute the first hole, and no gap is formed between them. Among various embodiments of this, in the case of the electrical connector 100 of the above embodiment and the variations thereof, the gap t is formed between the first press-fitting portion 121 and, out of the wall surfaces 111*f* on the two sides in the height direction among the wall surfaces that constitute the first hole 111*a* in the vertical wall 111, either the one wall surface 111*f* on the mounting side or the other wall surface 111*f* on the counter mounting side. This reliably prevents the application of pressure to the wall surfaces 111*f* on the two sides in the height direction among the wall surfaces that constitute the first hole 111*a* in the vertical wall 111 during the press-fitting of the first press-fitting portion 121. This reliably obtains effects such as the comparatively small inclination of the wall 115 between the recessed portion 111*d* and the first hole 111*a* being kept approximately the same, and preventing the wall 115 between the recessed portion 111*d* and the first hole 111*a* from being pressed toward the mounting side by pressure during press-fitting, thus further increasing the possibility of obtaining favorable co-planarity between the first leg portion 123 and the second leg portion 133, and further suppressing soldering defects in the electrical connector 100.

In the electrical connector of the present invention, it is sufficient that the recessed portion is recessed from the counter mating side toward the mating side between the first hole and the second hole in the vertical wall. Among various embodiments of this, in the case of the electrical connector 100 of the first variation, ribs 111*i* that connect, out of the wall surfaces that constitute the recessed portion 111*d* in the vertical wall 111, the wall surface 111*j* on the mounting side and the wall surface 111*k* on the counter mounting side, are provided in correspondence with at least one out of the first holes 111*a* and the second holes 111*b*. According to this configuration, the reinforcing effect of the ribs 111*i* suppresses the inclination of the wall 115 between the recessed portion 111*d* and the first hole 111*a* and the inclination of the wall 116 between the recessed portion 111*d* and the second hole 111*b*, thus further increasing the possibility of obtaining favorable co-planarity between the first leg portion 123 and the second leg portion 133, and making it possible to further suppress soldering defects in the electrical connector 100.

The electrical connector of the present invention need only include the first terminal and the second terminal as terminals. Among various embodiments of this, in the case of the electrical connector 100 of the third variation and the fourth variation, one third hole 111*c* that passes through the vertical wall 111 in the mating direction or two or more third holes 111*c* that are separated in the height direction and pass through the vertical wall 111 in the mating direction are provided on the counter mounting side relative to the first holes 111*a* and on the mounting side relative to the second holes 111*b* in the vertical wall 111. Furthermore, the electrical connector 100 includes the same number of third terminals 140 as the number of third holes 111*c*, each of the third terminals 140 having the third press-fitting portion 141 that is fitted into the third hole 111*c*, the third contact portion 142 that protrudes from the third press-fitting portion 141 toward the mating side, and the third leg portion 143 that protrudes from the third press-fitting portion 141 toward the counter mating side and then extends toward the mounting side. The recessed portion 111*d* is divided into the first recessed portion 111*da* that is provided between the first hole 111*a* and the third hole 111*c* in the vertical wall 111, and a second recessed portion 111*db* that is provided between the third hole 111*c* and the second hole 111*b* in the vertical wall 111, or is divided into the first recessed portion 111*da* that is provided between the first hole 111*a* and the third hole 111*c* closest to the mounting side in the vertical wall 111, the second recessed portion 111*db* that is provided between the third hole 111*c* closest to the counter mounting side and the second hole 111*b* in the vertical wall 111, and the third recessed portion 111*dc* that is provided between third holes 111*c* that are adjacent in the height direction in the vertical wall 111. The third press-fitting portion 141 is press-fitted into the vertical wall 111 by coming into pressure contact with, among the wall surfaces that constitute the third hole 111*c* in the vertical wall 111, the wall surfaces 111*m* on the two sides in the width direction and the wall surfaces 111*n* on the two sides in the height direction.

In the case of the electrical connector 100 of the third variation and the fourth variation, when the housing 110 without the first terminal 120, the second terminal 130, and the third terminal 140 press-fitted therein receives heat from a heating means such as a reflow soldering apparatus, due to thermal deformation, the wall 115 between the first recessed portion 111*da* and the first hole 111*a* becomes inclined such that the tip of the wall 115 on the counter mating side moves closer to the mounting side than the mating side portion, and a wall 117 between the first recessed portion 111*da* and the third hole 111*c* becomes inclined such that the tip of the wall 117 on the counter mating side moves closer to the counter mounting side than the mating side portion, and the inclination of the wall 117 between the first recessed portion 111*da* and the third hole 111*c* tends to be larger than the inclination of the wall 115 between the first recessed portion 111*da* and the first hole 111*a*. Also, the wall 116 between the second recessed portion 111*db* and the second hole 111*b* becomes inclined such that the tip of the wall 116 on the counter mating side moves closer to the counter mounting side than the mating side portion, and the inclination of the wall 116 between the second recessed portion 111*db* and the second hole 111*b* tends to be larger than the inclination of the wall 115 between the first recessed portion 111*da* and the first hole 111*a*. Furthermore, in the case where two or more third holes 111*c* that are separated in the height direction and pass through the vertical wall 111 in the mating direction are provided on the counter mounting side relative to the first holes 111*a* and on the mounting side relative to the second holes 111*b* in the vertical wall 111, as in the electrical connector 100 of the fourth variation, the wall 117 between the third recessed portion 111*dc* and the third hole 111*c* on the counter mounting side relative to that third recessed portion 111*dc* is inclined such that the tip of the wall 117 on the counter mating side moves closer to the counter mounting side than the mating side portion, and the inclination of the wall 117 between the third recessed portion 111*dc* and the third hole 111*c* tends to be larger than the inclination of the wall 115 between the first recessed portion 111*da* and the first hole 111*a*. For this reason, if the press-fitting of the first press-fitting portions 121 into the vertical wall 111, the press-fitting of the second press-fitting portions 131 into the vertical wall 111, and the press-fitting of the third press-fitting portions 141 into the vertical wall 111 are performed under the same conditions, deviation occurs between height direction displacement of the first leg portions 123, the second leg portions 133, and the third leg portions 143, and this impairs the co-planarity of the first leg portions 123, the second leg portions 133, and the third leg portions 143. However, in the case of the above-described electrical connector 100, in the press-fitting of first press-fitting portion 121, pressure is not applied to the wall surfaces 111*f* on the two sides in the height direction among the wall surfaces that constitute the first hole 111*a* in the vertical wall 111, and therefore the comparatively small inclination of the wall 115 between the first recessed portion 111*da* and the first hole 111*a* is kept approximately the same. On the other hand, in the press-fitting of the second press-fitting portion 131, pressure is applied to the wall surfaces 111*h* on the two sides in the height direction among the wall surfaces that constitute the second hole 111*b* in the vertical wall 111, and therefore due to this pressure, the wall 116 between the second recessed portion 111*db* and the second hole 111*b* is pressed toward the mounting side, and the inclination thereof decreases. Also, in the press-fitting of the third press-fitting portion 141, pressure is applied to the wall surfaces 111*n* on the two sides in the height direction among the wall surfaces that constitute the third hole 111*c* in the vertical wall 111, and therefore due to this pressure, the wall 117 between the third recessed portion 111*dc* and the third hole 111*c* is pressed toward the mounting side, and the inclination thereof decreases. This suppresses the case where the second leg portion 133 and the third leg portion 143 become more displaced toward the counter mounting side than the first leg portion 123, thus raising the possibility of obtaining favorable co-planarity between the first leg portion 123, the second leg portion 133, and the third leg portion 143. Also, in the press-fitting of the first press-fitting portion 121, pressure is not applied to the wall surfaces 111*f* on the two sides in the height direction among the wall surfaces that constitute the first hole 111*a* in the vertical wall 111, and therefore the wall 115 between the first recessed portion 111*da* and the first hole 111*a* is not pressed toward the mounting side by pressure in the press-fitting. This reduces the risk of an increase in the size of the gap in the height direction between the first leg portion 123 and the second and third leg portions 133 and 143, and reduces the risk of impairing the co-planarity between the first leg portion 123 and the second and third leg portions 133 and 143. Accordingly, effects similar to the electrical connector 100 of the above embodiment can also be obtained in the electrical connector 100 of the third variation and the fourth variation that include the first terminal 120, the second terminal 130, and the third terminal 140.

In the case of the electrical connector of the present invention that includes the first terminal, the second terminal, and the third terminal as with the electrical connector 100 of the third variation and the fourth variation, there are no limitations on the magnitude relationship that the pressure between the third press-fitting portion and the wall surfaces on the two sides in the height direction among the wall surfaces that constitute the third hole in the vertical wall has with the pressure between the second press-fitting portion and the wall surfaces on the two sides in the height direction among the wall surfaces that constitute the second hole in the vertical wall. Among various embodiments of this, in the case of the electrical connector 100 of the third variation and the fourth variation, the pressure between the third press-fitting portion 141 and the wall surfaces 111*n* on the two sides in the height direction among the wall surfaces that constitute the third hole 111*c* in the vertical wall 111, and the pressure between the second press-fitting portion 131 and the wall surfaces 111*h* on the two sides in the height direction among the wall surfaces that constitute the second hole 111*b* in the vertical wall 111 are set so as to be higher the closer the press-fitting portion is to the counter mounting side.

In the case of the electrical connector 100 of the third variation and the fourth variation, there is a tendency for the third leg portion 143 to become more displaced toward the counter mounting side than the first leg portion 123, and for the second leg portion 133 to become more displaced toward the counter mounting side than the third leg portion 143. Also, in the case of third leg portions 143 that are adjacent in the height direction, there is a tendency for the third leg portion 143 on the counter mounting side to become more displaced toward the counter mounting side than the third leg portion 143 on the mounting side. For this reason, if the pressures between the wall surfaces and the first press-fitting portion 121, the third press-fitting portion 141, and the second press-fitting portion 131 are set higher with increasing proximity to the counter mounting side, there is a further decrease in the risk of an increase in the size of the gap in the height direction with the third leg portion 143 and the second leg portion 133 and between adjacent third leg portions 143, there is a further decrease in the risk of impairing the co-planarity between the first leg portion 123 and the second and third leg portions 133 and 143, and it is possible to further suppress soldering defects in the electrical connector 100.

An overview of embodiments of the present invention will be described below.

1) An electrical connector having terminals at different heights according to a first aspect of the present invention is an electrical connector having terminals at different heights that includes:

a housing having a vertical wall that faces a mating direction and rises from a mounting side toward a counter mounting side along a height direction that is orthogonal to the mating direction, and being provided with a first hole that passes through the vertical wall in the mating direction and a second hole that passes through the vertical wall in the mating direction on the counter mounting side relative to the first hole;

a first terminal having a first press-fitting portion that is fitted into the first hole, a first contact portion that protrudes from the first press-fitting portion toward a mating side, and a first leg portion that protrudes from the first press-fitting portion toward a counter mating side and then extends toward the mounting side; and a second terminal having a second press-fitting portion that is fitted into the second hole, a second contact portion that protrudes from the second press-fitting portion toward the mating side, and a second leg portion that protrudes from the second press-fitting portion toward the counter mating side and then extends toward the mounting side, wherein a recessed portion that is recessed from the counter mating side toward the mating side is provided between the first hole and the second hole in the vertical wall, the first press-fitting portion is press-fitted into the vertical wall by coming into pressure contact with, among wall surfaces that constitute the first hole in the vertical wall, wall surfaces on two sides in a width direction that is orthogonal to the mating direction and the height direction, and the second press-fitting portion is press-fitted into the vertical wall by coming into pressure contact with, among wall surfaces that constitute the second hole in the vertical wall, wall surfaces on two sides in the width direction and wall surfaces on two sides in the height direction.

When the housing without the first terminal and the second terminal press-fitted therein receives heat from a heating means such as a reflow soldering apparatus, due to thermal deformation, a wall between the recessed portion and the first hole becomes inclined such that the tip of the wall on the counter mating side moves closer to the mounting side than the mating side portion, and a wall between the recessed portion and the second hole becomes inclined such that the tip of the wall on the counter mating side moves closer to the counter mounting side than the mating side portion, and the inclination of the wall between the recessed portion and the second hole tends to be larger than the inclination of the wall between the recessed portion and the first hole. For this reason, if the press-fitting of the first press-fitting portion into the vertical wall and the press-fitting of the second press-fitting portion into the vertical wall are performed under the same conditions, deviation occurs between height direction displacement of the first leg portion and the second leg portion, and this impairs the co-planarity of the first leg portion and the second leg portion. However, in the case of the above-described electrical connector having terminals at different heights, in the press-fitting of first press-fitting portion, pressure is not applied to the wall surfaces on the two sides in the height direction among the wall surfaces that constitute the first hole in the vertical wall, and therefore the comparatively small inclination of the wall between the recessed portion and the first hole is kept approximately the same. On the other hand, in the press-fitting of the second press-fitting portion, pressure is applied to the wall surfaces on the two sides in the height direction among the wall surfaces that constitute the second hole in the vertical wall, and therefore due to this pressure, the wall between the recessed portion and the second hole is pressed toward the mounting side, and the inclination thereof decreases. This suppresses the case where the second leg portion becomes more displaced toward the counter mounting side than the first leg portion, thus raising the possibility of obtaining favorable co-planarity between the first leg portion and the second leg portion. Also, in the press-fitting of the first press-fitting portion, pressure is not applied to the wall surfaces on the two sides in the height direction among the wall surfaces that constitute the first hole in the vertical wall, and therefore the wall between the recessed portion and the first hole is not pressed toward the mounting side by pressure in the press-fitting. This reduces the risk of an increase in the size of the gap in the height direction between the first leg portion and the second leg portion, and reduces the risk of impairing the co-planarity of the first leg portion and the second leg portion.

With the electrical connector having terminals at different heights according to the first aspect, the first press-fitting portion is press-fitted into the vertical wall by the first press-fitting portion coming into pressure contact with the wall surfaces on the two sides in the width direction among the wall surfaces that constitute the first hole in the vertical wall, and the second press-fitting portion is press-fitted into the vertical wall by the second press-fitting portion coming into pressure contact with, among the wall surfaces that constitute the second hole in the vertical wall, the wall surfaces on the two sides in the width direction and the wall surfaces on the two sides in the height direction, and thus it is possible to raise the possibility of obtaining favorable co-planarity between the first leg portion and the second leg portion, and to suppress soldering defects in the electrical connector having terminals at different heights.

2) According to a second aspect of an electrical connector having terminals at different heights of the present invention, in the electrical connector having terminals at different heights according to the first aspect, a flat surface that comes into contact with, among the wall surfaces that constitute the second hole in the vertical wall, a wall surface on the mounting side, is formed on the mounting side of the second press-fitting portion.

According to this configuration, when the wall between the recessed portion and the second hole is pressed toward the mounting side due to the pressure in the press-fitting of the second terminal, pressure is likely to be uniformly applied to the wall, and thus inclination of the wall is uniformly suppressed, and there is an even higher possibility of obtaining favorable co-planarity between the first leg portion and the second leg portion.

The electrical connector having terminals at different heights according to the second aspect obtains the effects obtained by the electrical connector having terminals at different heights according to the first aspect, and additionally, the flat surface that comes into contact with, among the wall surfaces that constitute the second hole in the vertical wall, the wall surface on the mounting side, is formed on the mounting side of the second press-fitting portion, thus further raising the possibility of obtaining favorable co-planarity between the first leg portion and the second leg portion, and making it possible to further suppress soldering defects in the electrical connector having terminals at different heights.

3) According to a third aspect of an electrical connector having terminals at different heights of the present invention, in the electrical connector having terminals at different heights according to the first or second aspect, a gap is formed between the first press-fitting portion and, among the wall surfaces that constitute the first hole in the vertical wall, a wall surface on the mounting side or a wall surface on the counter mounting side.

This configuration reliably prevents the application of pressure to the wall surfaces on the two sides in the height direction among the wall surfaces that constitute the first hole in the vertical wall during the press-fitting of the first press-fitting portion. This reliably obtains effects such as the comparatively small inclination of the wall between the recessed portion and the first hole being kept approximately the same, and preventing the wall between the recessed portion and the first hole from being pressed toward the mounting side by pressure during press-fitting, thus further increasing the possibility of obtaining favorable co-planarity between the first leg portion and the second leg portion.

The electrical connector having terminals at different heights according to the third aspect obtains the effects obtained by the electrical connector having terminals at different heights according to the first or second aspects, and additionally, a gap is formed between the first press-fitting portion and, out of the wall surfaces that constitute the first hole in the vertical wall, either the one wall surface on the mounting side or the other wall surface on the counter mounting side, thus making it possible to further raise the possibility of obtaining favorable co-planarity between the first leg portion and the second leg portion, and making it possible to further suppress soldering defects in the electrical connector having terminals at different heights.

4) According to a fourth aspect of an electrical connector having terminals at different heights of the present invention, in the electrical connector having terminals at different heights according to any one of the first to third aspects, a rib that connects a wall surface on the mounting side and a wall surface on the counter mounting side among wall surfaces that constitute the recessed portion in the vertical wall, is provided in correspondence with at least one of the first hole and the second hole.

According to this configuration, the reinforcing effect of the rib suppresses the inclination of the wall between the recessed portion and the first hole and the inclination of the wall between the recessed portion and the second hole, thus further increasing the possibility of obtaining favorable co-planarity between the first leg portion and the second leg portion.

The electrical connector having terminals at different heights according to the fourth aspect obtains the effects obtained by the electrical connector having terminals at different heights according to any of the first to third aspects, and additionally, a rib that connects, out of the wall surfaces that constitute the recessed portion in the vertical wall, the wall surface on the mounting side and the wall surface on the counter mounting side, is provided in correspondence with at least one of the first hole and the second hole, and the reinforcing effect of the rib makes it possible to further raise the possibility of obtaining favorable co-planarity between the first leg portion and the second leg portion, and makes it possible to further suppress soldering defects in the electrical connector having terminals at different heights.

5) According to a fifth aspect of an electrical connector having terminals at different heights of the present invention, in the electrical connector having terminals at different heights according to any one of the first to fourth aspects, one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further includes a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

When the housing without the first terminal, the second terminal, and the third terminal press-fitted therein receives heat from a heating means such as a reflow soldering apparatus, due to thermal deformation, the wall between the first recessed portion and the first hole becomes inclined such that the tip of the wall on the counter mating side moves closer to the mounting side than the mating side portion, and a wall between the first recessed portion and the third hole becomes inclined such that the tip of the wall on the counter mating side moves closer to the counter mounting side than the mating side portion, and the inclination of the wall between the first recessed portion and the third hole tends to be larger than the inclination of the wall between the first recessed portion and the first hole. Also, the wall between the second recessed portion and the second hole becomes inclined such that the tip of the wall on the counter mating side moves closer to the counter mounting side than the mating side portion, and the inclination of the wall between the second recessed portion and the second hole tends to be larger than the inclination of the wall between the first recessed portion and the first hole. Furthermore, in the case where two or more third holes that are separated in the height direction and pass through the vertical wall in the mating direction are provided on the counter mounting side relative to the first holes and on the mounting side relative to the second holes in the vertical wall, the wall between the third recessed portion and the third hole on the counter mounting side relative to that third recessed portion is inclined such that the tip of the wall on the counter mating side moves closer to the counter mounting side than the mating side portion, and the inclination of the wall between the third recessed portion and the third hole tends to be larger than the inclination of the wall between the first recessed portion and the first hole. For this reason, if the press-fitting of the first press-fitting portions into the vertical wall, the press-fitting of the second press-fitting portions into the vertical wall, and the press-fitting of the third press-fitting portions into the vertical wall are performed under the same conditions, deviation occurs between height direction displacement of the first leg portions, the second leg portions, and the third leg portions, and this impairs the co-planarity of the first leg portions, the second leg portions, and the third leg portions. However, in the case of the above-described electrical connector having terminals at different heights, in the press-fitting of first press-fitting portion, pressure is not applied to the wall surfaces on the two sides in the height direction among the wall surfaces that constitute the first hole in the vertical wall, and therefore the comparatively small inclination of the wall between the first recessed portion and the first hole is kept approximately the same. On the other hand, in the press-fitting of the second press-fitting portion, pressure is applied to the wall surfaces on the two sides in the height direction among the wall surfaces that constitute the second hole in the vertical wall, and therefore due to this pressure, the wall between the second recessed portion and the second hole is pressed toward the mounting side, and the inclination thereof decreases. Also, in the press-fitting of the third press-fitting portion, pressure is applied to the wall surfaces on the two sides in the height direction among the wall surfaces that constitute the third hole in the vertical wall, and therefore due to this pressure, the wall between the third recessed portion and the third hole is pressed toward the mounting side, and the inclination thereof decreases. This suppresses the case where the second leg portion and the third leg portion become more displaced toward the counter mounting side than the first leg portion, thus raising the possibility of obtaining favorable co-planarity between the first leg portion, the second leg portion, and the third leg portion. Also, in the press-fitting of the first press-fitting portion, pressure is not applied to the wall surfaces on the two sides in the height direction among the wall surfaces that constitute the first hole in the vertical wall, and therefore the wall between the first recessed portion and the first hole is not pressed toward the mounting side by pressure in the press-fitting. This reduces the risk of an increase in the size of the gap in the height direction between the first leg portion and the second and third leg portions, and reduces the risk of impairing the co-planarity between the first leg portion and the second and third leg portions.

According to the electrical connector having terminals at different heights according to the fifth aspect, the effects obtained by the electrical connector having terminals at different heights according to any of the first to fourth aspects can be obtained with an electrical connector having terminals at different heights that includes the first terminal, the second terminal, and the third terminal.

6) According to a sixth aspect of an electrical connector having terminals at different heights of the present invention, in the electrical connector having terminals at different heights according to the fifth aspect, a pressure between the third press-fitting portion and the wall surfaces on the two sides in the height direction among the wall surfaces that constitute the third hole in the vertical wall, and a pressure between the second press-fitting portion and the wall surfaces on the two sides in the height direction among the wall surfaces that constitute the second hole in the vertical wall are set so as to be higher the closer the press-fitting portion is to the counter mounting side.

There is a tendency for the third leg portion to become more displaced toward the counter mounting side than the first leg portion, and for the second leg portion to become more displaced toward the counter mounting side than the third leg portion. Also, in the case of third leg portions that are adjacent in the height direction, there is a tendency for the third leg portion on the counter mounting side to become more displaced toward the counter mounting side than the third leg portion on the mounting side. For this reason, if the pressures between the wall surfaces and the first press-fitting portion, the third press-fitting portion, and the second press-fitting portion are set higher with increasing proximity to the counter mounting side, there is a further decrease in the risk of an increase in the size of the gap in the height direction with the third leg portion and the second leg portion and between adjacent third leg portions, there is a further decrease in the risk of impairing the co-planarity between the first leg portion and the second and third leg portions.

The electrical connector having terminals at different heights according to the sixth aspect can further obtain the effects obtained by the electrical connector having terminals at different heights according to the fifth aspect.

The electrical connector having terminals at different heights of the present invention encompass embodiments that are combinations of features of the above-described embodiment and variations. Furthermore, the above-described embodiment and variations are merely several examples of the electrical connector having terminals at different heights of the present invention. Accordingly, the electrical connector having terminals at different heights of the present invention is not intended to be limited by the descriptions of the embodiment and variations.

The invention claimed is:

1. An electrical connector having terminals at different heights, comprising:

a housing having a vertical wall that faces a mating direction and rises from a mounting side toward a counter mounting side along a height direction that is orthogonal to the mating direction, and being provided with a first hole that passes through the vertical wall in the mating direction and a second hole that passes through the vertical wall in the mating direction on the counter mounting side relative to the first hole;

a first terminal having a first press-fitting portion that is fitted into the first hole, a first contact portion that protrudes from the first press-fitting portion toward a mating side, and a first leg portion that protrudes from the first press-fitting portion toward a counter mating side and then extends toward the mounting side; and a second terminal having a second press-fitting portion that is fitted into the second hole, a second contact portion that protrudes from the second press-fitting portion toward the mating side, and a second leg portion that protrudes from the second press-fitting portion toward the counter mating side and then extends toward the mounting side, wherein a recessed portion that is recessed from the counter mating side toward the mating side is provided between the first hole and the second hole in the vertical wall, the first press-fitting portion is press-fitted into the vertical wall by coming into pressure contact with, among wall surfaces that constitute the first hole in the vertical wall, wall surfaces on two sides in a width direction that is orthogonal to the mating direction and the height direction, and the second press-fitting portion is press-fitted into the vertical wall by coming into pressure contact with, among wall surfaces that constitute the second hole in the vertical wall, wall surfaces on two sides in the width direction and wall surfaces on two sides in the height direction.

2. The electrical connector having terminals at different heights according to claim 1, wherein a flat surface that comes into contact with, among the wall surfaces that constitute the second hole in the vertical wall, a wall surface on the mounting side, is formed on the mounting side of the second press-fitting portion.

3. The electrical connector having terminals at different heights according to claim 2, wherein a gap is formed between the first press-fitting portion and, among the wall surfaces that constitute the first hole in the vertical wall, a wall surface on the mounting side or a wall surface on the counter mounting side.

4. The electrical connector having terminals at different heights according to claim 3, wherein a rib that connects a wall surface on the mounting side and a wall surface on the counter mounting side among wall surfaces that constitute the recessed portion in the vertical wall, is provided in correspondence with at least one of the first hole and the second hole.

5. The electrical connector having terminals at different heights according to claim 4, wherein one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further comprises a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

6. The electrical connector having terminals at different heights according to claim 3, wherein one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further comprises a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

7. The electrical connector having terminals at different heights according to claim 2, wherein a rib that connects a wall surface on the mounting side and a wall surface on the counter mounting side among wall surfaces that constitute the recessed portion in the vertical wall, is provided in correspondence with at least one of the first hole and the second hole.

8. The electrical connector having terminals at different heights according to claim 7, wherein one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further comprises a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

9. The electrical connector having terminals at different heights according to claim 2, wherein one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further comprises a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

10. The electrical connector having terminals at different heights according to claim 9, wherein a pressure between the third press-fitting portion and the wall surfaces on the two sides in the height direction among the wall surfaces that constitute the third hole in the vertical wall, and a pressure between the second press-fitting portion and the wall surfaces on the two sides in the height direction among the wall surfaces that constitute the second hole in the vertical wall are set so as to be higher the closer the press-fitting portion is to the counter mounting side.

11. The electrical connector having terminals at different heights according to claim 1, wherein a gap is formed between the first press-fitting portion and, among the wall surfaces that constitute the first hole in the vertical wall, a wall surface on the mounting side or a wall surface on the counter mounting side.

12. The electrical connector having terminals at different heights according to claim 11, wherein a rib that connects a wall surface on the mounting side and a wall surface on the counter mounting side among wall surfaces that constitute the recessed portion in the vertical wall, is provided in correspondence with at least one of the first hole and the second hole.

13. The electrical connector having terminals at different heights according to claim 12, wherein one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further comprises a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

14. The electrical connector having terminals at different heights according to claim 11, wherein one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further comprises a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

15. The electrical connector having terminals at different heights according to claim 14, wherein a pressure between the third press-fitting portion and the wall surfaces on the two sides in the height direction among the wall surfaces that constitute the third hole in the vertical wall, and a pressure between the second press-fitting portion and the wall surfaces on the two sides in the height direction among the wall surfaces that constitute the second hole in the vertical wall are set so as to be higher the closer the press-fitting portion is to the counter mounting side.

16. The electrical connector having terminals at different heights according to claim 1, wherein a rib that connects a wall surface on the mounting side and a wall surface on the counter mounting side among wall surfaces that constitute the recessed portion in the vertical wall, is provided in correspondence with at least one of the first hole and the second hole.

17. The electrical connector having terminals at different heights according to claim 16, wherein one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further comprises a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

18. The electrical connector having terminals at different heights according to claim 17, wherein a pressure between the third press-fitting portion and the wall surfaces on the two sides in the height direction among the wall surfaces that constitute the third hole in the vertical wall, and a pressure between the second press-fitting portion and the wall surfaces on the two sides in the height direction among the wall surfaces that constitute the second hole in the vertical wall are set so as to be higher the closer the press-fitting portion is to the counter mounting side.

19. The electrical connector having terminals at different heights according to claim 1, wherein one third hole that passes through the vertical wall in the mating direction or two or more third holes that are separated in the height direction and pass through the vertical wall in the mating direction are provided on the counter mounting side relative to the first hole and on the mounting side relative to the second hole, the electrical connector having terminals at different heights further comprises a third terminal, the number of third terminals corresponding to the number of third holes, and each third terminal having a third press-fitting portion that is fitted into the third hole, a third contact portion that protrudes from the third press-fitting portion toward the mating side, and a third leg portion that protrudes from the third press-fitting portion toward the counter mating side and then extends toward the mounting side, the recessed portion is divided into a first recessed portion provided between the first hole and the third hole in the vertical wall, and a second recessed portion provided between the third hole and the second hole in the vertical wall, or is divided into a first recessed portion provided between the first hole and the third hole closest to the mounting side in the vertical wall, a second recessed portion provided between the third hole closest to the counter mounting side and the second hole in the vertical wall, and a third recessed portion provided between third holes that are adjacent in the height direction in the vertical wall, and the third press-fitting portion is press-fitted into the vertical wall by coming into pressure contact with, among wall surfaces that constitute the third hole in the vertical wall, wall surfaces on two sides in the width direction and wall surfaces on two sides in the height direction.

20. The electrical connector having terminals at different heights according to claim 19, wherein a pressure between the third press-fitting portion and the wall surfaces on the two sides in the height direction among the wall surfaces that constitute the third hole in the vertical wall, and a pressure between the second press-fitting portion and the wall surfaces on the two sides in the height direction among the wall surfaces that constitute the second hole in the vertical wall are set so as to be higher the closer the press-fitting portion is to the counter mounting side.

* * * * *